United States Patent [19]

Fuller, Jr.

[11] Patent Number: 4,787,176

[45] Date of Patent: Nov. 29, 1988

[54] DRILL BIT SHARPENING APPARATUS

[75] Inventor: Robert L. Fuller, Jr., Issaquah, Wash.

[73] Assignee: The Boeing Company, Seattle, Wash.

[21] Appl. No.: 822,198

[22] Filed: Jan. 24, 1986

[51] Int. Cl.[4] ..... B24B 19/00

[52] U.S. Cl. ..... 51/5 R; 51/215 R; 51/215 CP; 51/215 UE; 51/219 R; 414/225; 901/7

[58] Field of Search ..... 51/5 R, 105 R, 131.1, 51/215 R, 215 CP, 215 H, 215 AR, 215 HM, 215 UE, 219 R, 219 PC, 288, 94 R; 76/5 R, 108 R, 108 T; 414/225, 226, 744 A; 901/6-7

[56] References Cited

U.S. PATENT DOCUMENTS

| | | | |
|---|---|---|---|
| 2,615,353 | 10/1952 | Ives | 76/5 |
| 2,767,599 | 10/1956 | McKain | 76/5 |
| 2,796,703 | 6/1957 | Bushey et al. | 51/215 H X |
| 2,848,847 | 8/1958 | Casselman | 51/219 R X |
| 2,870,579 | 1/1959 | Siemsen et al. | 51/94 |
| 2,883,887 | 4/1959 | McKain | 76/5 |
| 3,040,480 | 6/1962 | Winslow et al. | 51/94 |
| 3,104,561 | 9/1963 | Mitchell | 76/5 |
| 3,117,471 | 1/1964 | O'Connell et al. | 76/108 |
| 3,239,966 | 3/1966 | Richardson | 51/92 |
| 3,327,568 | 6/1967 | Meyer | 76/89.2 |
| 3,400,499 | 9/1968 | Pew | 51/219 |
| 3,488,886 | 1/1970 | Braum et al. | 51/3 |
| 3,560,175 | 2/1971 | Buchanan | 51/96 |
| 3,572,519 | 3/1971 | Tezuka | 414/744 A |
| 3,675,372 | 7/1972 | Kushigian | 51/89 X |
| 3,711,997 | 1/1973 | Kushigian | 51/105 |
| 3,828,480 | 8/1974 | Weng | 51/85 |
| 3,951,271 | 4/1976 | Mette | 414/744 A X |
| 4,068,414 | 1/1978 | Breitenstein et al. | 51/288 X |
| 4,107,882 | 8/1978 | Breitenstein | 51/118 |
| 4,209,087 | 6/1980 | Kushigian | 51/215 CP X |
| 4,380,295 | 4/1983 | Soderberg et al. | 209/558 |
| 4,475,320 | 10/1984 | Webster | 51/288 |
| 4,489,523 | 12/1984 | Webster | 51/165 |

OTHER PUBLICATIONS

The Formsprag Company Catalog #2106 entitled, "Over-Running Clutches".

*Primary Examiner*—Robert P. Olszewski
*Attorney, Agent, or Firm*—Delbert J. Barnard

[57] ABSTRACT

A walking beam conveyor (54) delivers drill bits (B), one at a time, into a feed position. A pushrod (52) moves a drill bit (B) from the feed position into the nosepiece (36) of a robot arm (28). The drill bit (B) enters the nosepiece (36) shank end first. The shank (84) enters into and is gripped by a collet (38) in the nosepiece (36). A stylus (66) is then lowered down onto the point end portion of the drill bit (B) and the drill bit (B) is rotated about its axis until the stylus (66) drops down to the bottom of the drill bit flute (70). Rotation is immediately stopped and the robot arm (28) is retracted and swung into a position of alignment with a drill bit holder (18) of a sharpening machine. The robot arm (28) is then extended to place the drill bit (B) into a collet (C) in the holder (18). The collet (C) is operated to grasp the drill bit (B) and the collet (38) in the nosepiece (36) is operated to release the drill bit (B). The holder (18) then moves in position to in turn move the point of the drill bit (B) into contact with a surface of a rotating grinding wheel (14). The drill bit (B) was rotated while in the nosepiece (36) to in that manner orient the point surfaces of the drill bit for proper contact with the grinding wheel (14). Oversized and undersized drill bits (B), and drill bits (B) with excessive material buildup, are detected and rejected.

28 Claims, 24 Drawing Sheets

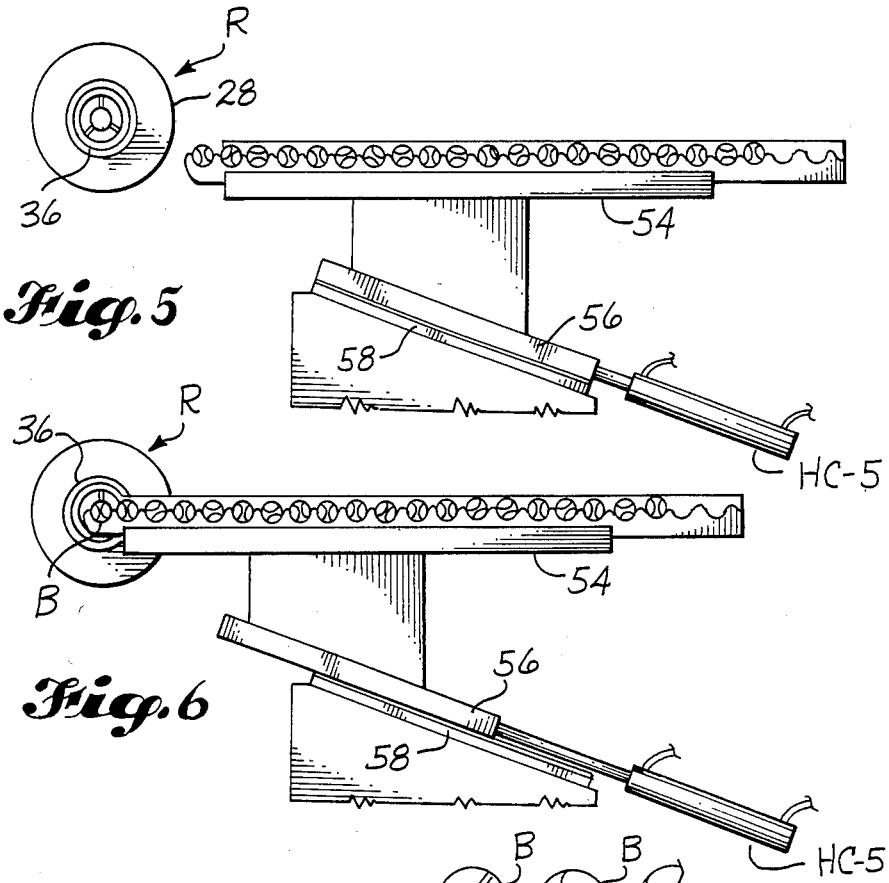
Fig. 5
Fig. 6
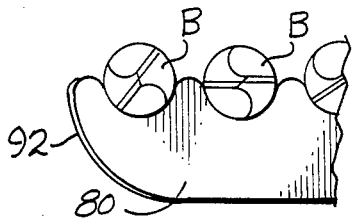
Fig. 9
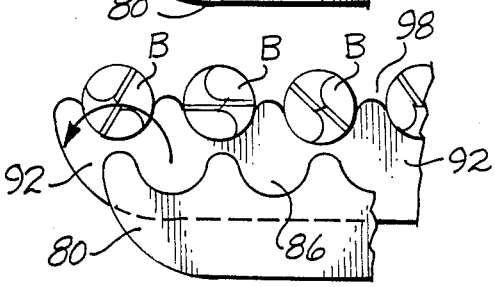
Fig. 10
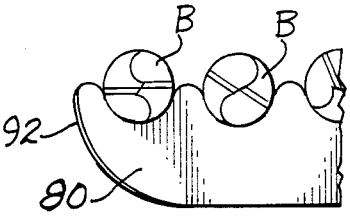
Fig. 11

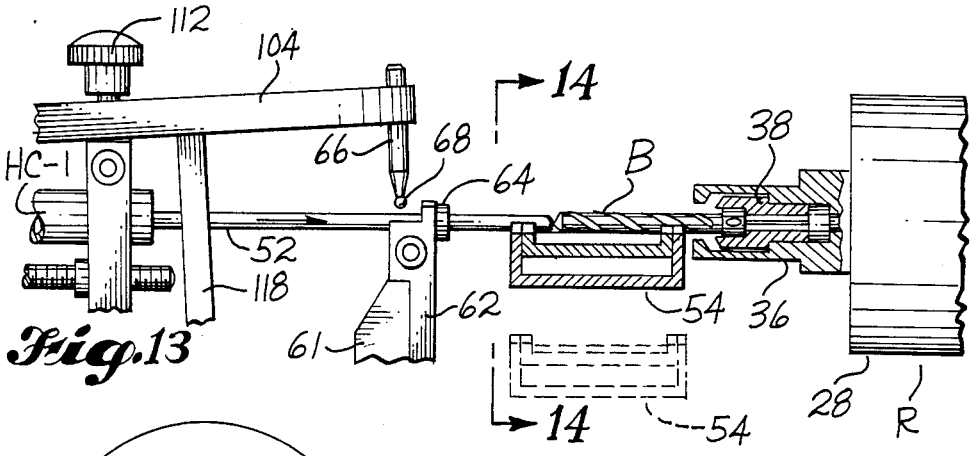
Fig.13
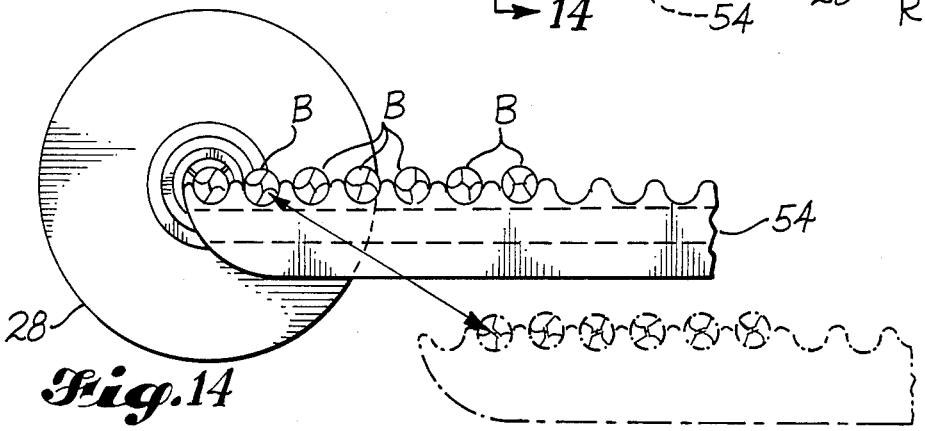
Fig.14
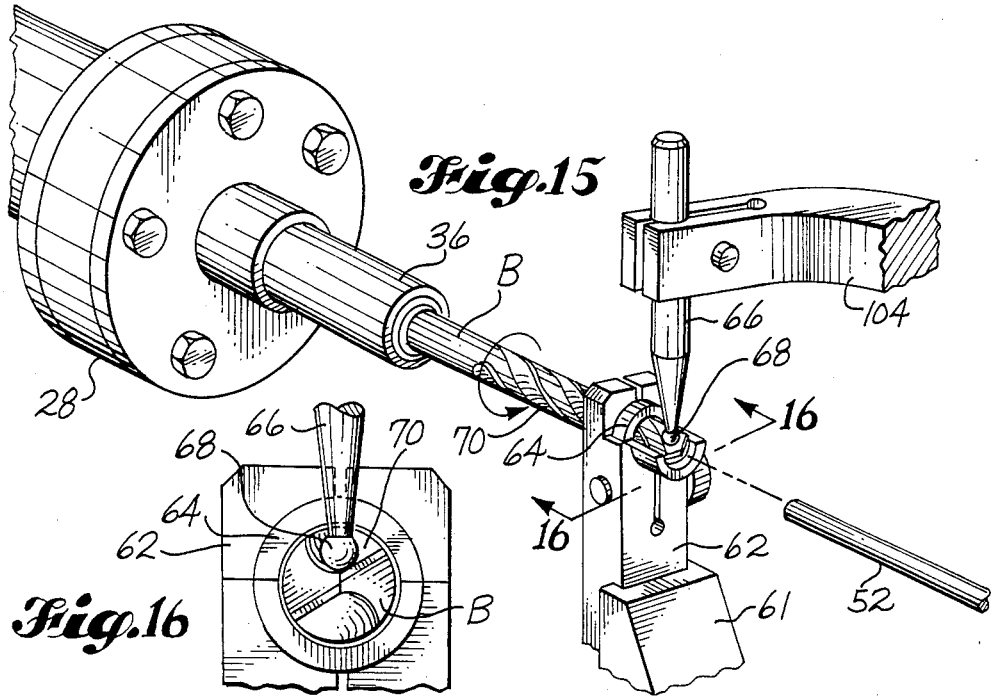
Fig.15
Fig.16

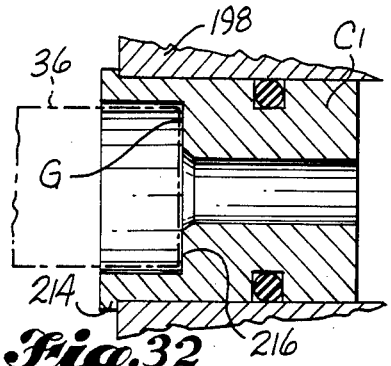
Fig.32
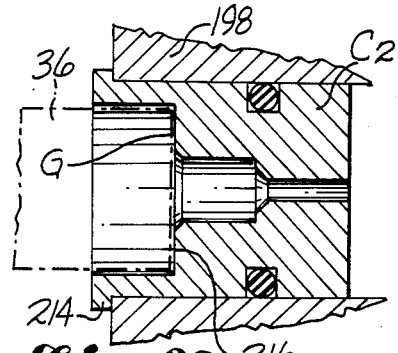
Fig.33
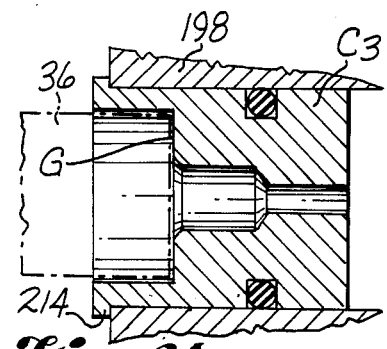
Fig.34
Fig.35
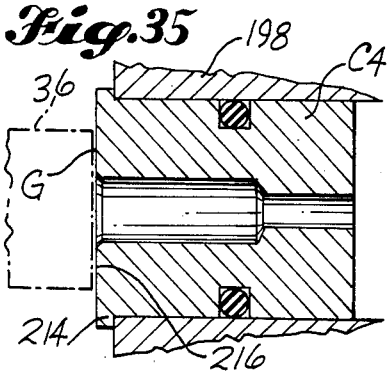
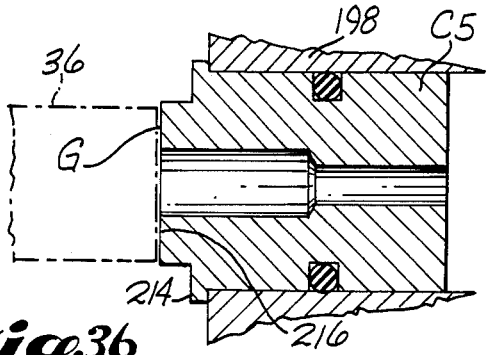
Fig.36
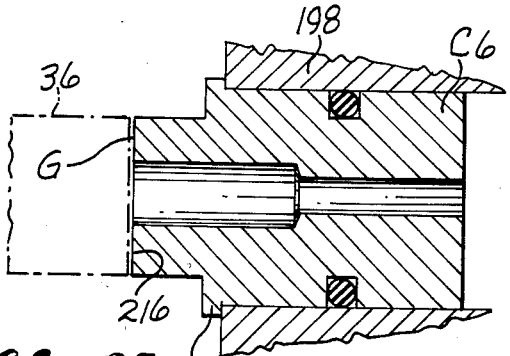
Fig.37
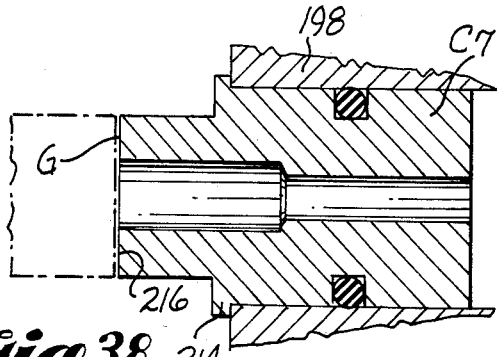
Fig.38
Fig.39
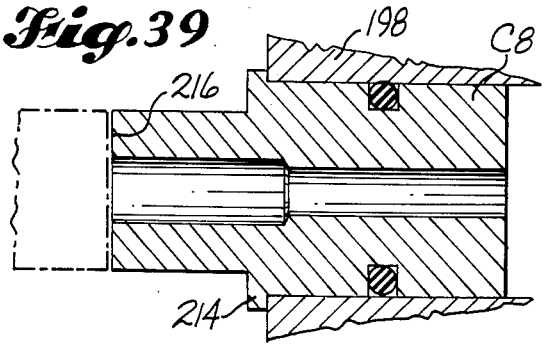

DRILL BIT SHARPENING APPARATUS

DESCRIPTION

1. Technical Field

This invention relates to the sharpening of drill bits. More particularly, it relates to a method and apparatus for automatically feeding quick-change type drill bits into an automatic sharpening machine.

2. Background of the Invention

Many manufacturing operations (e.g. the manufacture of aircraft) require the drilling of a large number of holes of varying sizes. Drill bits are used until they become dull and then they are resharpened. In a typical aircraft manufacturing plant, it is necessary to resharpen an extremely large number of drill bits each week. By way of example, approximately 30,000 general purpose quick-change drill bits are resharpened each week by The Boeing Company at a facility in Auburn, Wash.

A so-called "quick-change" drill bit is a type of drill bit which can be easily and quickly installed into and removed from the power drill with which it is used without it being necessary for the operator to loosen and tighten a chuck every time that a used drill is removed and a new drill is inserted. This type of drill bit has an adapter at its shank end which is larger in diameter than the rest of the drill bit. This type of drill bit is disclosed in U.S. Pat. No. 4,347,660, entitled Quick-Change Drill Assembly and Machine, and granted Sept. 7, 1982, to Michael R. Cannon, Robert L. Fuller, Jr. and Dwayne E. Proff. This patent is owned by The Boeing Company of Seattle, Wash.

One type of resharpening of a drill bit is referred to in the art as "pointing" or "repointing". This operation constitutes grinding a conical tip on the drill bit. A known drill bit point grinding machine includes a drill bit holder into which the drill bits are fed one at a time, by an operator. The operator must both hand load each drill bit into the holder and manually index the drill bit to a proper orientation relative to the grinding wheel. Following orientation, the operator actuates a switch which starts an automatic grinding cycle. Following completion of the cycle, the operator manually removes the drill bit from the drill bit holder. The present invention was developed for the purpose of eliminating these manual steps.

3. Identification of Prior Art

The drill bit sharpening machine referred to above is a Winslow Model 100C drill point grinder, manufactured by Giddings & Lewis-Bickford Machine Company, of 820 Highland Avenue, Kaukauna, Wisc., U.S.A. 54130. The basic principles of this machine are disclosed in U.S. Pat. No. 3,040,480, granted June 26, 1962, to James C. Winslow and Harold O. Houser. In order to adapt this machine for use in the practice of the present invention, it was necessary to provide it with new collets and a new drill bit end stop and ejector mechanism, and to coordinate its controls with the controls of the drill bit feeding mechanism.

A Seiko Model 700 Robot was acquired from Seiko Instruments U.S.A., of 2990 W. Lomita Blvd., Torrance, Calif. 90505, and was modified to serve as the drill bit carrier. This type of robot includes a horizontal arm assembly that is mounted on top of a vertical column. The column can be rotated and raised up and down, for the purpose of swinging the arm assembly and moving it up and down. The arm assembly includes a housing and an arm extendible out from and retractable into the housing. The robot came with an air motor mounted onto the closed end of the housing. The air motor provided on hundred and eighty degrees of clockwise and counterclockwise rotation of the arm. This air motor drive had to be replaced with a new drive mechanism which would give continuous rotation. It was also necessary to develop a nosepiece with a drill bit collet and substitute it for a gripper which was positioned at the outer end of the arm.

A known drill bit locator was obtained from Normac, Inc. of P.O. Box 768, Hendersonville, N.C. 28739, and used in the system, for indexing or orienting the drill bits while they are in the grasp of the collet in the nosepiece of the robot arm. The locator is in principle similar to a locator disclosed by U.S. Pat. No. 3,711,997, granted Jan. 23, 1973, to Anthony Kushigian. This same patent discloses a known hopper-type feed system for a drill bit sharpening machine which cannot be used for sharpening quick-change type drill bits because of the adaptor on the shank of the drill bit.

A known type of walking beam conveyor was obtained from Normac and modified. One modification involved mounting the entire conveyor to reciprocate toward and away from a position in which the last drill bit at the discharge end of the conveyor is in alignment with the nosepiece on the robot arm. Other changes were made to the conveyor for the purpose of making it adjustable for use with many sizes of drill bit.

DESCRIPTION OF THE INVENTION

The present invention required the selection and modification of several known devices (identified above), and the combining of the modified devices with each other and with new devices to form a new system, involving new arrangements and new uses of the old devices, and further required the creation of a new control system, altogether resulting in the provision of a new apparatus and method for sharpening drill bits, capable of being used for sharpening quick-change drill bits.

In basic form, the system of the present invention comprises a drill bit sharpening machine of a type which includes a drill bit holder into which the drill bits are fed, one at a time, point end first. A drill bit carrier is provided which is movable between a drill bit receiving position and a drill bit inserting position. The drill bit carrier includes a collet for receiving the shank end of each drill bit. The collet is rotatable in position about its axis which is also the drill bit axis. A mechanism is provided for inserting a drill bit into the collet when the drill bit carrier is in its drill bit receiving position. Following insertion, the collet is closed to grip the drill bit. The position of the drill bit in the collet is sensed and the collet and drill bit are rotated about the drill bit axis until the sensor determines that the point of the drill bit has been positioned for proper contact with the grinding wheel of the sharpening machine. Then the carrier is moved from its drill bit receiving position into its drill bit inserting position, at which time the drill bit is aligned with the drill bit holder of the sharpening machine. Next the collet of the drill bit carrier is moved endwise an amount sufficient to insert the drill bit into the drill bit holder. Then the collet is opened to release the drill bit. Next the drill bit carrier is moved back into its drill bit receiving position, for receiving another drill bit.

By way of example, the drill bit carrier may be a robotic mechanism of a type comprising a generally horizontal arm which is swingable in position about a generally vertical axis. The drill bit receiving position is at one end of the swing path of the arm and the drill bit inserting position is at the opposite end of the swing path.

In accordance with a feature of the invention, the drill bit is fed into a position of spaced axial alignment with the collet of the drill bit carrier, when said carrier is in its drill bit receiving position. A pushrod is positioned to be extendible against the point end of the drill bit, for moving the drill bit endwise from such position toward the collet, and its shank end into the collet.

In preferred form, a walking beam conveyor is used advance a plurality of drill bits sideways, to an end position on the conveyor. The conveyor is mounted for reciprocal movement between an extended position, in which a drill at the end position is in the position of spaced axial alignment with the collet, and a retracted position.

In accordance with another feature of the invention, the locator includes a stylus positioned to enter a flute of the drill bit. The stylus is associated with a sensor which senses a predetermined position of the stylus in the flute and stops rotation of the collet in response to the stylus reaching such predetermined position. In preferred form, the stylus is positioned generally vertically above the drill bit so that it falls by gravity into the flute.

In accordance with still another feature of the invention, the drill bit is positioned in and supported by a bushing while it is being indexed. The bushing is mounted for movement between a position in which the drill bit is in the bushing and a retracted position in which the bushing is spaced axially from the drill bit point. The bushing is retracted out of the way when the conveyor is advanced to place a drill bit into position to be fed into the collet of the robot arm, and the conveyor retracted out of the way when the bushing is positioned to support the drill bit during indexing.

Additional features of the invention, which are described below in the description of the Best Mode for Carrying Out the Invention, include a manner of loading the drill bits into the carrier collet in such a way that the length of the projecting part of the drill bit is always the same, regardless of the total length of the drill bit, a manner of detecting and rejecting drill bits having an excessive build-up of material in their flutes, a manner of detecting and rejecting oversized drill bits, a manner of detecting and rejecting undersized drill bits, a manner of easily adjusting both the sharpening machine and the drill bit feeder mechanism, for handling different diameter drill bits, a construction and operation of a robotic feed arm for rotational indexing of each drill bit while it is in a carrier collet located at the outer end of the arm, and the integration of the operation of the arm with the operation of the other components of the drill bit feed mechanism, and with the various operations of the drill bit sharpening machine.

BRIEF DESCRIPTION OF THE DRAWINGS

Like reference numerals and letters are used to denote like parts throughout the several views of the drawings, and:

FIG. 5 is a somewhat schematic side elevational view looking toward one side of the drill bit conveyor, showing the conveyor in its retracted position;

FIG. 6 is a view like FIG. 5, but showing the conveyor extended to place a drill bit in line with the nosepiece of the robot arm;

FIG. 9 is a side elevational view of the discharge end of the conveyor, showing the lifter in a down position;

FIG. 10 is a view like FIG. 8, but showing the lifter in the process of moving upwardly and forwardly to advance the drill bits;

FIG. 11 is a view like FIGS. 9 and 10, showing the lifter back in its down position and the drill bits advanced one position;

FIG. 13 is a view of the upper portion of FIG. 12, showing the pushrod being extended for the purpose of pushing the drill bit off from the conveyor and into the nosepiece of the robot arm;

FIG. 14 is a sectional view taken substantially along line 14—14 of FIG. 13;

FIG. 15 is a pictorial view of the robot arm and drill bit in the process of being rotated, with the ball end of a stylus positioned in a flute of the drill bit;

FIG. 16 is a sectional view taken substantially along line 16—16 of FIG. 15, showing the ball end of the stylus in a bottom position in the flute;

FIGS. 32–39 are axial sectional views through a group of eight different holder collets, provided for eight different diameters of drill bits to be sharpened, such views showing the change in location of the gauge surface which is used for properly orienting the position of a drill bit in the carrier collet with the holder collet;

BEST MODE FOR CARRYING OUT THE INVENTION

Figure 1:
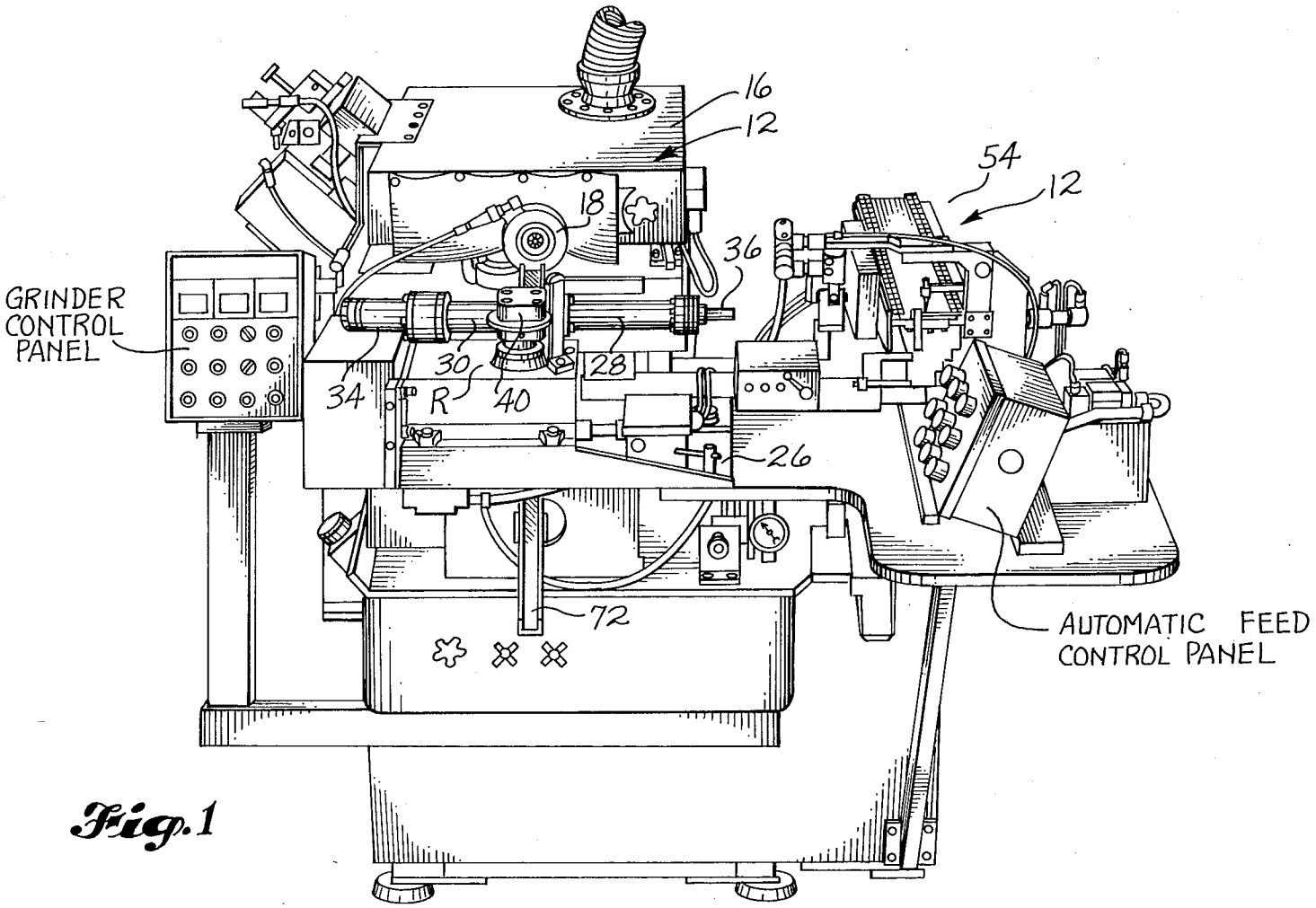
FIG. 1 is a pictorial view of a mechanism embodying the present invention, such view being taken from above and looking toward the front of the mechanism.
Figure 3:
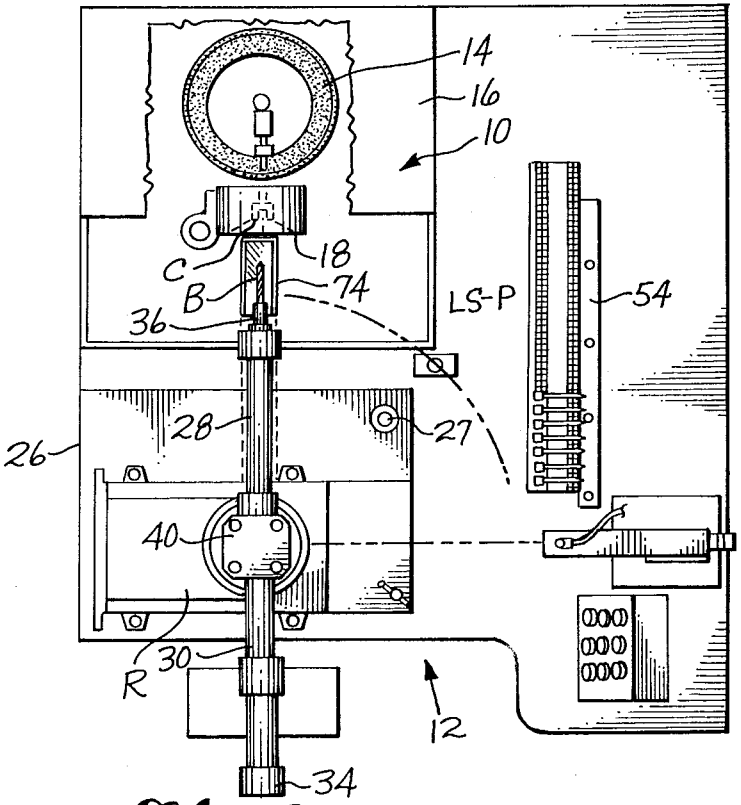
FIG. 3 is a view like FIG. 2, but showing the robot arm swung into its feed position.
Figure 2:
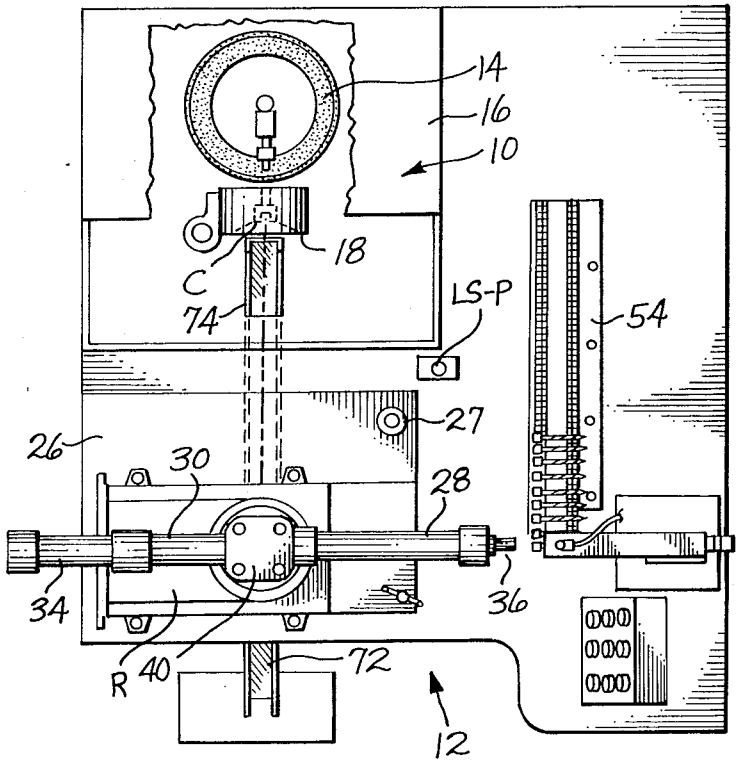
FIG. 2 is a somewhat schematic top plan view of the basic components of the mechanism, showing the robot arm positioned to receive a drill bit, with a portion of the housing for the grinding wheel being cut away to disclose the grinding wheel.
Figure 4:
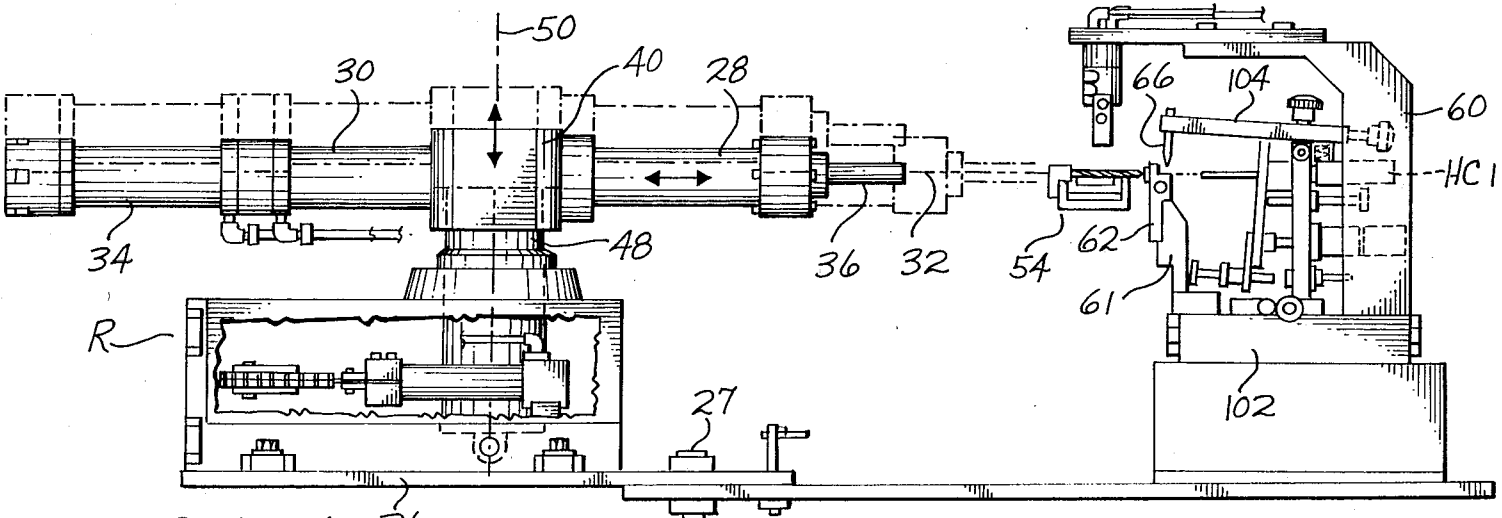
FIG. 4 is an enlarged scale front elevational view of the robot arm assembly in its drill bit receiving position and a portion of the mechanism for feeding drill bits into the nosepiece of the robot arm, such view showing the down retracted position of the arm in solid line and the down extended and up retracted positions in broken line.

Referring to FIGS. 1–3, the apparatus of the present invention comprises a drill bit point sharpening machine 10 and an automatic drill bit feed mechanism 12. By way of typical and therefore nonlimitive example, the drill bit sharpening machine 10 may be a Winslow Model 100C drill point grinder manufactured by Giddings and Lewis-Bickford Machine Company, of 820 Hyland Avenue, Kaukauna, Wisc., U.S.A. 54130. The illustrated system includes this machine.

The drill bit point sharpening machine 10 comprises a grinding wheel 14 located within a housing 16. A drill bit holder 18 is provided for receiving a drill bit B and moving it against the grinding wheel 14 during grinding. Holder 18 includes a bushing 20 (FIGS. 24–26) positioned close to the grinding wheel 14 and a collet C positioned axially outwardly from the bushing 20. In use, a drill bit B, to be sharpened, is inserted point end first into the holder 18. At the time of drill bit insertion, the holder 18 is in an up position (FIG. 24) and the bushing 20 and the collet C are in line with a stop 22. The drill bit B is moved into the holder 18 until its tip contacts the stop 22.

Figures 24, 25, 26:
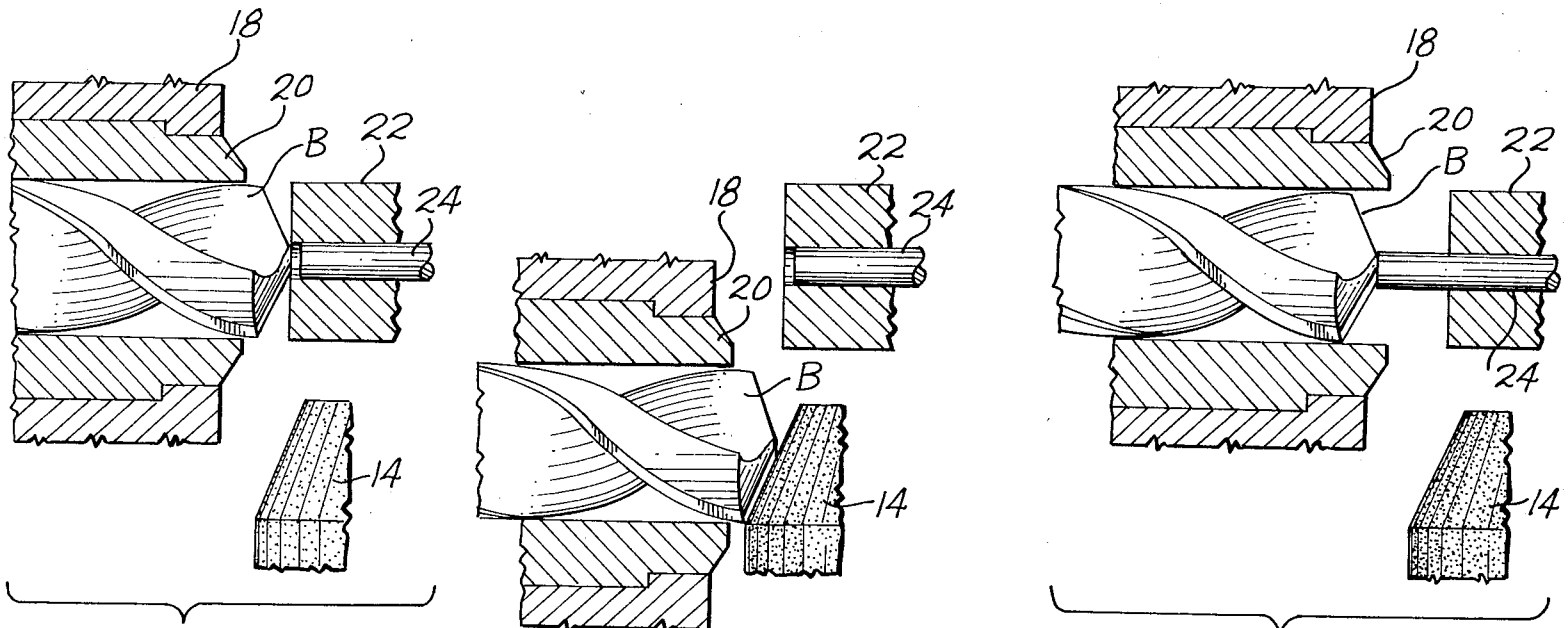
FIG. 24 is a fragmentary axial sectional view through a portion of the drill bit holder, showing an end portion of the drill bit in side elevation, positioned against a stop, and showing the holder and the drill bit elevated above a grinding wheel.
FIG. 25 is a view like FIG. 24, showing the drill bit holder and the drill bit lowered to place the tip of the drill bit into contact with the grinding wheel.
FIG. 26 is a view like FIGS. 24 and 25, showing the drill bit holder and the drill bit elevated, and showing a pushrod extending out through the center of the stop for ejecting the drill bit from the drill bit holder.

The illustrated machine 10 was constructed for manual feed of drill bits B into the holder 18 by an operator. As described in the before-mentioned U.S. Pat. No. 3,040,480, when the drill bits B are fed into the holder 18 manually, a type of stop is used which is constructed to align the drill bit B into a proper position for grinding in response to an endwise movement of the drill bit B against the stop. A locator element (not shown) was provided on the old stop. In use, the operator would manually rotate the drill bit B until the locator element came into contact with the leading edge of a flute and stopped further rotation. Then, the collet C is closed tightly around the drill bit B (by the operator pressing on a foot control) and the holder 18 is moved downwardly to position the drill bit B for the start of the grinding operation (FIG. 25). As also explained in U.S. Pat. No. 3,040,480, the holder 18 is moved relative to the grinding wheel 14, while the grinding wheel 14 is rotated, for making proper contact between the drill bit point and the grinding wheel 14.

Figure 22:
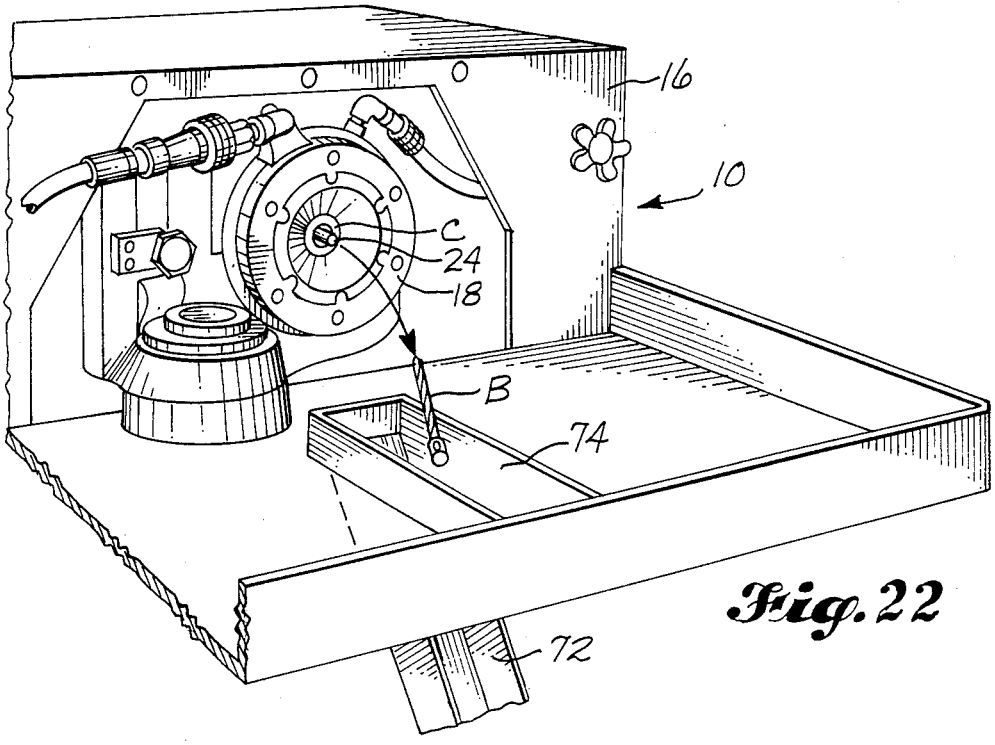
FIG. 22 is a view like FIG. 21, showing a sharpened drill bit being ejected from the drill bit holder and into a discharge chute.

At the end of the grinding cycle, the holder 18 and the drill bit B are raised to a position in which the drill bit B is in alignment with the stop 22. The collet C is opened and an eject pin 24 is extended out through the stop 22 and against the end of the drill bit B, for pushing it out from the holder 18, toward the operator (FIGS. 22 and 26).

The automatic drill bit feed system 12 comprises a robot R for inserting drill bits B into the drill bit holder 18, in place of manual feed by an operator. It also includes mechanism for delivering drill bits B to the robot R and mechanism for orienting the drill bit point surfaces for proper contact with the grinding wheel while the drill bit B is being held by the robot R, prior to insertion of the drill bit B into the drill bit holder 18.

The stop (not shown) in machine 10 that is used during manual feed is replaced with a stop 22 of the type illustrated when the machine 10 is converted to automatic feed. In other words, a stop 22 is installed which does not include a locator element. This is because in the system of the invention, the drill bit B is oriented prior to its insertion into the holder 18.

The collet C in holder 18 is also replaced by a collet comprising three jaw segments banded together by an O-ring. This type of collet C will expand and contract with the segments parallel.

Preferably, the robot R is mounted on a pivotal base 26, for pivotal movement (counter-clockwise) about a pin 27, between an operational position in which it is situated forward of the drill bit holder 18 (FIGS. 1–4), and an out-of-the-way position (not shown) in which it is off to one side and the drill bit holder 18 is accessible to an operator, so that the machine 10 can be used manually, in the manner described above.

Pin 27 may be a shoulderbolt which, when loosened slightly, will allow pivotal movement of the base 26 about the axis of the shoulderbolt. The base 26 may include an opening which, when the base is in the operational position, receives a cap screw (not shown) which functions to secure the base 26 to the frame of machine 10.

The robot R comprises an elongated horizontal arm 28 which is extendible out from and retractable into an elongated horizontal housing 30. Arm 28 is also rotatable about its longitudinal axis 32. A hydraulic motor 34 rotates the arm 28. Motor 34 is mounted at the end of the housing 30 opposite the arm 28.

Figure 12:
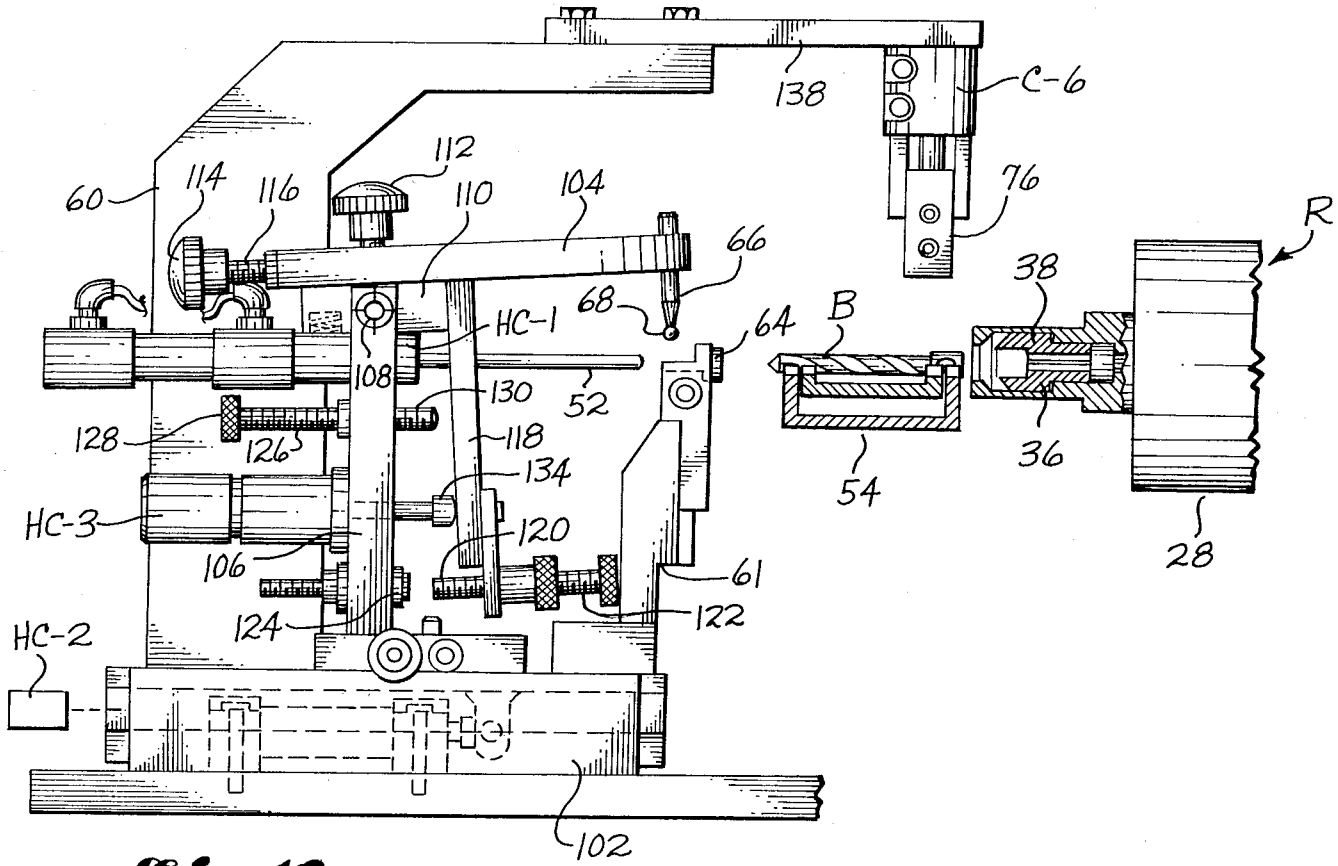
FIG. 12 is a side elevational view of the locator mechanism, with the stylus shown in an elevated position, the pushrod shown in a retracted position and a drill bit shown in a position to be loaded into the nosepiece of the robot arm.

The outer end of the arm 28 carries a nosepiece 36 in which a drill bit collet 38 (FIG. 12) is located. the particular robot R that is illustrated is a modified Seiko Model 700 robot. The Seiko Model 700 robot comes with an air vane rotator at the closed end of housing 30 and a gripper at the outer end of arm 28. The gripper was removed and replaced by the nosepiece 36 and collet 38. The air rotator was replaced by a hydraulic motor. These and other modifications are hereinafter described in more detail.

Figure 19:
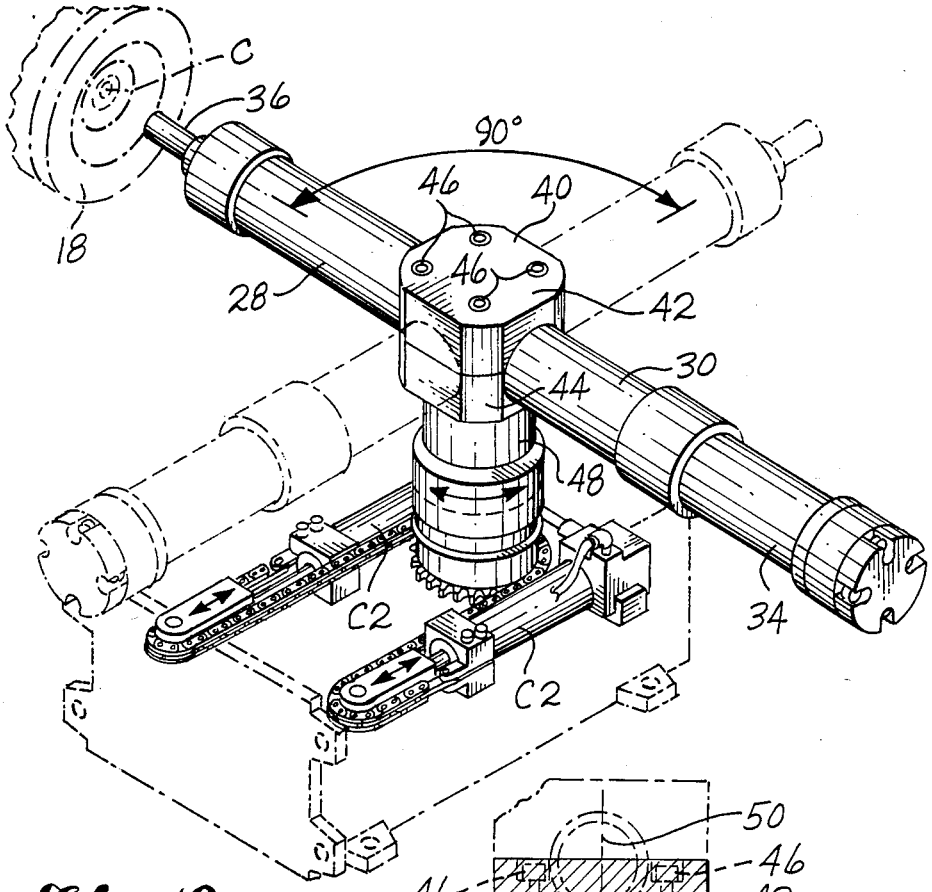
FIG. 19 is a pictorial view of the robot, with a portion of the lower housing shown in broken line, showing a mechanism provided for swinging the robot arm between its two positions, such view including a solid line showing of the robot arm in its feed position and a broken line showing of the robot arm in its drill bit receiving position.
Figure 20:
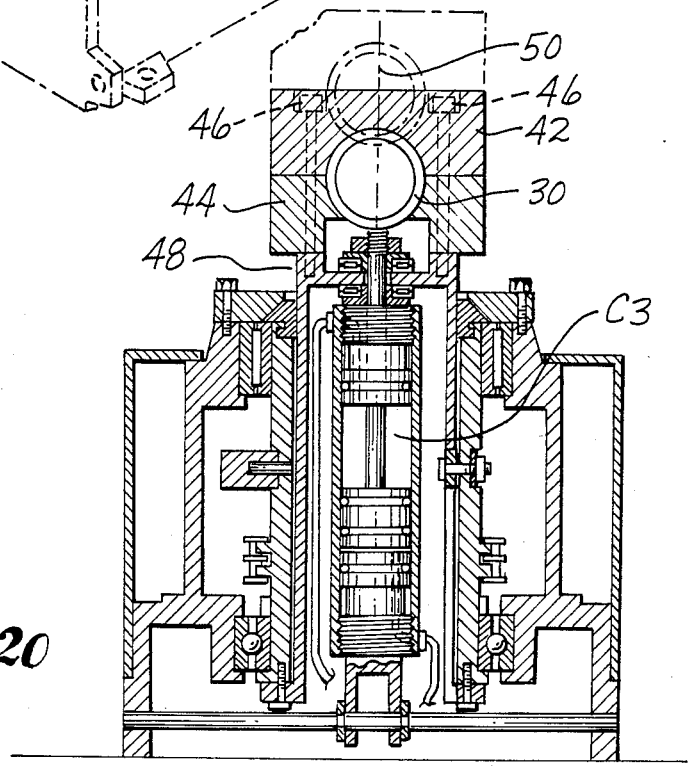
FIG. 20 is a vertical axial sectional view taken through the column which supports the arm assembly.
Figure 21:
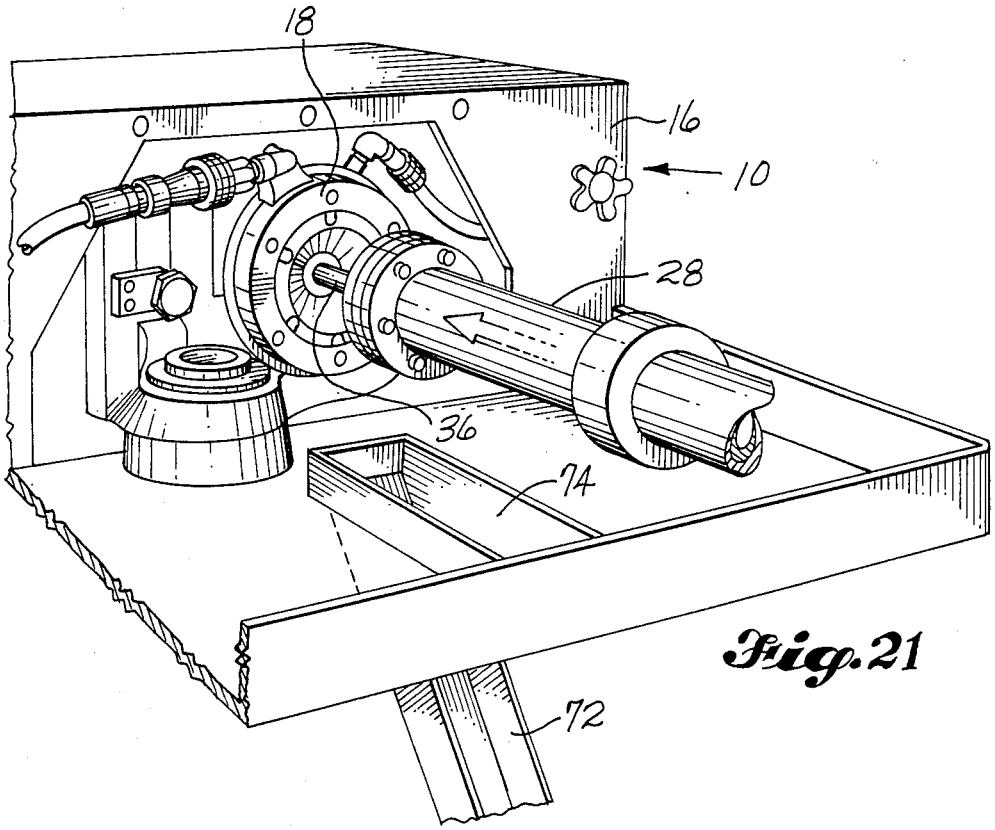
FIG. 21 is a pictorial view showing the robot arm in the process of inserting a drill bit into the drill bit holder of the sharpening machine.

The horizontal housing 30 is connected to a head 40 by means of a clamping action. The head 40 includes an upper part 42 which is connected to a lower part 44 by a set of socket bolts 46 (FIGS. 19 and 20). The bolts 46 are loosened, to relieve the clamping pressure. Then, the housing 30 is slid one way or the other for changing its position. Then the bolts 46 are tightened for the purpose of reclamping the housing 30 to the head 40, in its new position. The robot arm 28 is positioned such that when in its feed position, and extended, the end of its nosepiece 36 is positioned according to the size of the collet C. A different collet C is used for each size of drill bit B (see FIGS. 32–39).

The robot head 40 is at the upper end of a column 48 which is both rotatable in position about a vertical axis 50, and movable up and down along such axis 50. Herein the axis 50 will be sometimes referred to as the swing axis. The axis 32 will be sometimes referred to as the robot arm axis.

As will hereinafter be described in more detail, the robot arm assembly 28,30 is swingable in position about the swing axis 50, between a drill bit receiving position and a drill bit feeding position. When the arm assembly 28,30 is in its drill bit feeding position the robot arm axis 32 coincides with the axes of the bushing 20 and collet C of the drill bit holder 18. In the illustrated embodiment, when the arm assembly 28,30 is in its drill bit receiving position, it is oriented substantially ninety degrees (90°) from its drill bit feed position.

In accordance with an aspect of the invention, a drill bit B is inserted into the nosepiece 36 of the robot arm 28. Then the arm 28 and the drill bit B are rotated about axis 32 an amount sufficient to properly position the point surfaces of the drill bit B for proper contact with the grinding wheel 14. Then the arm assembly 28,30 is swung in position and moved to align the drill bit B with the collet C and the bushing 20 of the drill bit holder 18. Then, the robot arm 28 is extended until the end of the nosepiece 36 stops in front of the collet C. Then, the collet C is closed to grasp the drill bit B. The collet 38 is opened to release the drill bit B from the robot arm 28, and the robot arm 28 is retracted. Then, the robot arm assembly 28,30 is swung back into its drill bit receiving position.

The mechanism for inserting drill bits B into the nosepiece of the robot arm 28 includes a suitable conveyor for delivering the drill bits B, one at a time, into a position of axial alignment with the center opening in the nosepiece 36. In the illustrated embodiment, the robot arm 28 is extended when it is in its drill bit receiving position. This brings the open end of the nosepiece 36 close to a drill bit B which has been positioned for insertion into the nosepiece 36. Then, a pushrod 52, located endwise of the drill bit B, opposite the nosepiece 36, and in axial alignment with both the drill bit B and the nosepiece 36, is extended to push the drill bit B into the nosepiece 36 (FIG. 13).

In the illustrated embodiment, the conveyor which feeds the drill bits B to the loading position is a walking beam type conveyor 54 (FIGS. 5 and 6). This conveyor 54 is mounted onto a slide block 56 which slides on an inclined slideway 58. By way of typical and therefore nonlimitative example, a well-known cross roller slide mechanism may be used to provide the slide block 56. This slide block 56 and slideway 58 mount the conveyor 54 for movement between a retracted position in which the endmost station on the conveyor is spaced rearwardly and downwardly from the path of movement of the pushrod 52, and an extended position in which such station is within the path of movement of the pushrod 52. The conveyor 54 reciprocates back and forth along a sloping path. When extended, the conveyor 54 moves both forwardly and upwardly. When retracted, it moves rearwardly and downwardly. A linear fluid motor 55 may be used to reciprocate the slide block 56 and the conveyor 54 carried thereby.

Figure 17:
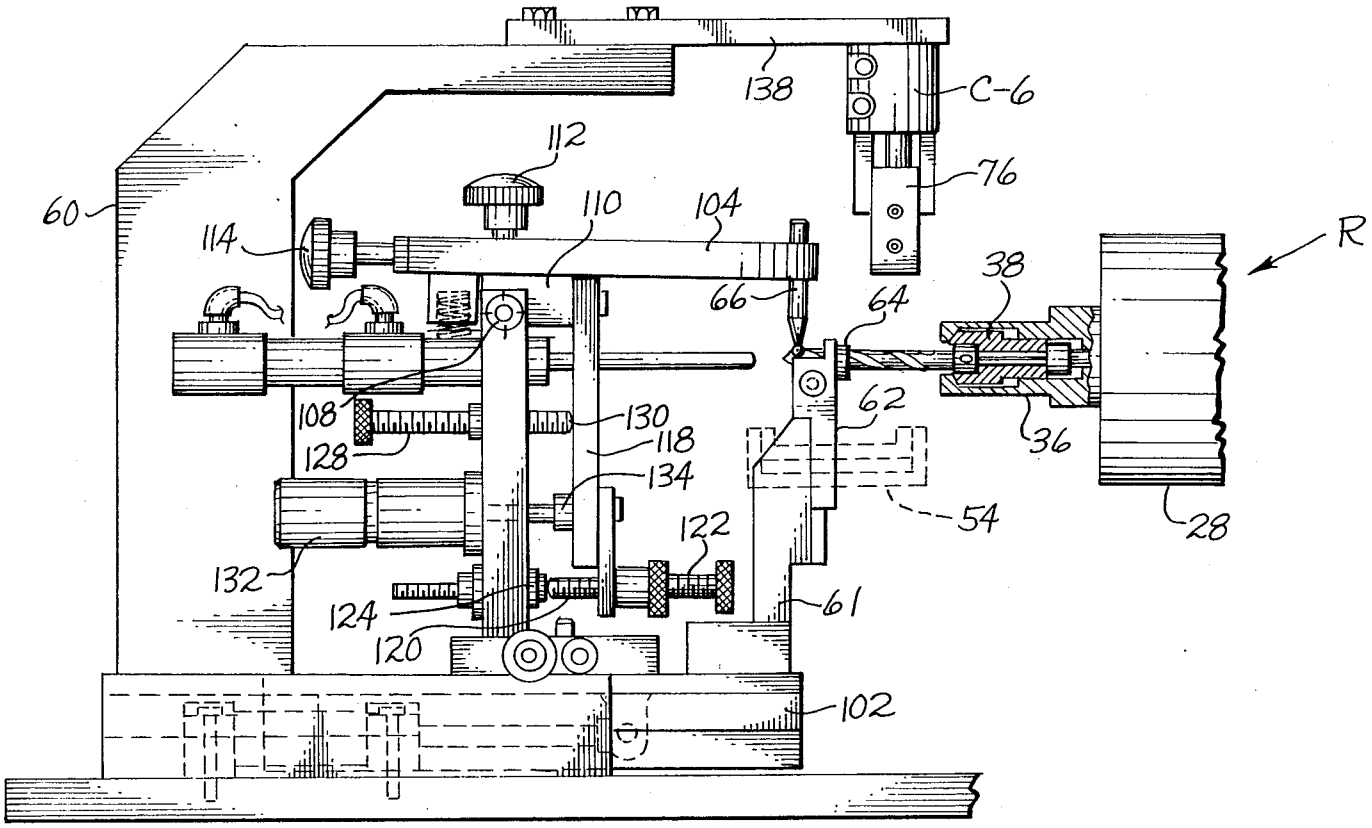
FIG. 17 is a view like FIG. 12, showing the position of the locator mechanism when the stylus is positioned in the bottom of the flute of the drill bit.

The conveyor 54 is retracted following a movement of the pushrod 52 to insert a drill bit into the nosepiece 36 of the robot arm 28. A standard 60 carries the pushrod 52. A second standard 61 also carries a bushing holder 62 which in turn carries a bushing 64. The center of the bushing 64 coincides with the center of the drill bit B. This second standard 61 is moved toward the drill bit B and the nosepiece 36. The bushing 64 and its support structure 61,62 are moved an amount sufficient to cause a point end portion of the stationary drill bit B to move into and through the bushing 64 (FIGS. 15–17).

The standard 61 also carries a stylus 66 which moves with bushing holder 62 and bushing 64, stylus 66 is positioned above the drill bit B during the movement. At the end of movement of the standard 60 the stylus 66 is allowed to drop downwardly by gravity until a round ball 68 at its lower end makes contact with the end portion of the drill bit which projects outwardly from the bushing 64. Then the robot R is operated to rotate the arm 28, the collet 38, and the drill bit B in the collet 38. As the drill bit rotates, the ball end 68 of the stylus 66 drops into the flute 70 of the drill bit B and rotation continues until the ball 68 is at the bottom of the flute 70. At this time a sensor (hereinafter described) that is associated with support structure for the stylus 66 functions to stop further rotation of the drill bit B. At this time the point portion of the drill bit B is in a position for proper contact with the grinding wheel 14 when the drill bit B is later inserted into the drill bit holder 18.

Figure 31:
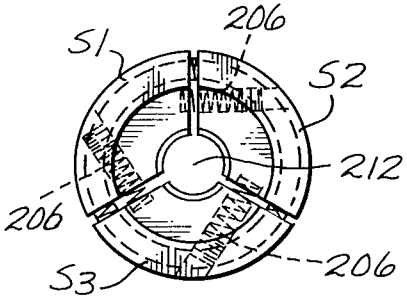
FIG. 31 is an end elevation view of the holder collet, showing the orientation of the springs which urge the collet jaws outwardly, to bias the holder collet in a normally open position.

Next, the drill bit arm is retracted (FIG. 4) and the arm assembly 28,30 is swung in position toward the sharpening machine 10 (FIGS. 3, 19 and 31). This swinging movement of the arm assembly 28,30 usually takes place at a level which at the end of the swing stroke positions the drill bit B in axial alignment with the collet C and bushing 20 in the drill bit holder 18.

The time of the grinding cycle varies with drill bit size. It takes less time to grind a smaller drill bit than it does a larger drill bit. The sharpening machine 10 includes a time control that is setable for establishing the grinding time interval for each drill bit B.

For some sizes of drill bits B, the time interval required for the robot arm 28 to receive a drill bit B and move it into position for insertion into the grinding machine 10 exceeds the time interval of a grinding cycle. When sharpening these bits, the robot arm 28 is swung from its drill bit receiving position into its drill bit feed position and is then immediately extended to insert the drill bit B into the drill bit holder 18. During operation in which the drilling cycle involves a larger time interval than the feed cycle, the robot arm 28 is moved into an elevated position (FIG. 4) during or at the end of the swing stroke and it stays in this position until the sharpening machine 10 is ready to receive another drill bit B. When it is ready, the arm 28 is lowered to the level of the drill bit holder 18 and then the robot arm 28 is extended to place a drill bit B into the drill bit holder 18.

As described in the aforementioned U.S. Pat. No. 3,040,480, the grinding wheel 14 is periodically dressed. For example, the sharpening machine 10 may be operated to sharpen ten drill bits and then function to dress the grinding wheel 14. The grinding wheel dressing step takes more time than a drill feed cycle. The robot control is connected to the sharpening machine control such that each time that the grinding wheel 14 is being dressed the robot arm assembly 28,30 is raised into its park position and held there until the sharpening machine 10 is ready to receive another drill bit B. Then the robot arm assembly 28,30 is lowered and the robot arm 28 is extended to place the drill bit B into the drill bit holder 18.

In accordance with an aspect of the invention, the sharpening machine 10 is provided with a drill bit receiving chute 72 having an upper end positioned to receive a drill bit B as it is released from the drill bit holder 18. The chute 72 extends downwardly an angle from the drill bit holder to a receiving receptacle for the sharpened drill bits. A deflector 74 is secured to the upper end of the chute 72 in a position to be contacted by each drill bit B as it is ejected from the drill bit holder 18. The drill deflector 74 does what its name implies. It deflects the drill bits B into the chute 72. The drill bit deflector 74 and the drill bit chute 72 are removably secured to the sharpening machine 10. This enables them to be removed and placed out of the way during manual operation of the machine 10.

In basic form, the walking beam conveyor 54 is a known mechanism. It comprises a shank cradle 78 on one of its sides and a point cradle 80 on the other side, connected together by a common frame. Cradle 78 includes a series of equally spaced-apart notches 82 sized and shaped to receive shank portions 84 of a plurality of drill bits B (FIGS. 7–11). Cradle 80 comprises a like number of equally spaced-apart notches 86 which are sized to receive point end portions of the drill bits B. A lifter 88 is positioned between the cradles 78,80. Lifter 88 includes a shank cradle 90 positioned inwardly adjacent the cradle 78 and a point cradle 92 positioned inwardly adjacent the cradle 80. Cradles 90,92 are connected together by a web 94. Cradle 90 includes a plurality of notches 96 which conform to the notches 82 in cradle 78. In like fashion, cradle 92 includes a plurality of notches 98 which conform to the notches 86 in the cradle 80.

An operator sets drill bits B in the notches 82,86,96,98. Following removal of a drill bit B from the endmost notch at the end of the conveyor adjacent the drill bit receiving position of the robot R, all of the drill bits B on the conveyor 54 are advanced one notch. To accomplish this, the lifter 88 is raised and moved forwardly and then downwardly and back to its original position, along an orbital path. As lifter 88 moves upwardly it lifts the drill bits B out of the notches 82,86 of the stationary cradles 78,80. When it moves downwardly, it places each drill bit B in the notches 82,86 positioned immediately forwardly of the notches 82,86 from which it was removed. The mechanism for causing the orbiting movement of lifter 88 is not a part of the present invention and therefore it is not illustrated.

In accordance with an aspect of the invention, a magnetic strip 100 is positioned immediately outwardly of the cradle 78. This magnetic strip 100 prevents the drill bits B from migrating one way or the other within the rows of notches 82, 96,98,86.

The support standard 61 for the bushing holder 62 and the bushing 64 is mounted at its lower end onto a slide block 102. As previously stated, the center axis of the bushing 64 coincides with the center axis 32 of the collect 38 within the nosepiece 36. Slideblock 102 moves along a path which maintains this relationship of the axes during movement.

The mechanism of the invention includes a plurality of bushing holders 62, a plurality of bushings 64, a plurality of pushrods 52, and a plurality of styluses 66. There is a different bushing for each size of drill bit. Each bushing holder 62 is usable with several sizes of bushing 64. Each pushrod 52 is usable with several drill bit sizes. Each drill bit B has its own stylus 66.

The stylus 66 is mounted to depend from an arm 104. The arm 104 is pivotally connected to an upper end portion of a column 106, for pivotal movement by horizontal axis 108.

Arm 104 is clamped to a block 110 and block 110 is pivotally attached to the post 106. Arm 104 is movable endwise to adjust its position relative to the block 110. This adjustment provides a way of adjusting the position of stylus 66 along the center line axis of the bushing 64. Adjustment is accomplished by the operator first loosening a clamp knob 112. Clamp know 112 includes a screw which extends through a longitudinal slot in the arm 104 and screws into the block 110. When the clamp knob 112 is tightened, it exerts a clamping pressure down on the arm 104, clamping it tight against the block 110. Following loosening of the clamp knob 112, a handle 114 is rotated to rotate an extension screw 116. Rotation of the screw 116 in one direction causes movement of the stylus 66 away from the post 106. Rotation of the screw 116 in the opposite direction moves the stylus 66 toward the post 106.

A vertical arm 118 is connected at its upper end to the block 110. Arm 118 depends from the block 110 and carries a peg 120 at its lower end. Peg 120 extends parallel to the arm 104. It is adjustable in position along its length, by means of screw threads 122. The free end of the peg 120 is directed toward a proximity sensor 124.

An adjustable stop screw 126, having an adjustment knob 128, is mounted on the post 106, above the sensor 124 and below the pivot axis 108. Adjustment screw 126 includes an end portion 130 which is positioned to make contact with a midportion of the vertical arm 118.

A cylinder 132 is mounted on the post 106, below the stop screw 126. Cylinder 132 includes a piston 134 which is extendible outwardly into contact with the arm 118. When the piston 134 is retracted, the stylus supporting end portion of the arm 104 drops and the vertical arm 118 swings rearwardly until it makes contact with the end portion 130 of the stop screw 126. The stop screw 126 is adjusted such that when the arm 118 is in contact with it end portion 130 the end of the peg 120 is in a position to actuate the sensor 124. When the piston 134 is extended, it exerts a force against the vertical arm 118, swinging such arm 118 away from the post 106, and at the same time raising the stylus supporting end portion of the horizontal arm 104. This raises the ball 68 at the lower end of the stylus 66 an amount sufficient to place the ball 68 above a drill bit situated within the bushing 64. Preferably, the lower end of the post 106 is adjustable in position on the slide block 102.

The various adjustments which have been described provide a way for adapting the mechanism for use with several sizes of drill bits and/or providing proper alignment.

A linear fluid motor 136 moves the slide block 102 back and forth along its slideway.

The pushrod 52 extends outwardly and back from the standard 60. The pushrod 52 may be the piston portion of a cylinder which is mounted on the standard 60. The pushrod 52 moves along a line which is aligned with the opening in the bushing 64.

The piston 134 of cylinder 132 is extended for the purpose of lifting the horizontal arm 104 and the stylus 66 during extension of the pushrod 52 for the purpose of pushing the endmost drill bit B off from the conveyor cradles 78,80 and into the nosepiece 36 of the robot arm 28. When piston 134 is extended, the stylus ball 68 is positioned above the path of travel of the pushrod 52.

Figure 18:
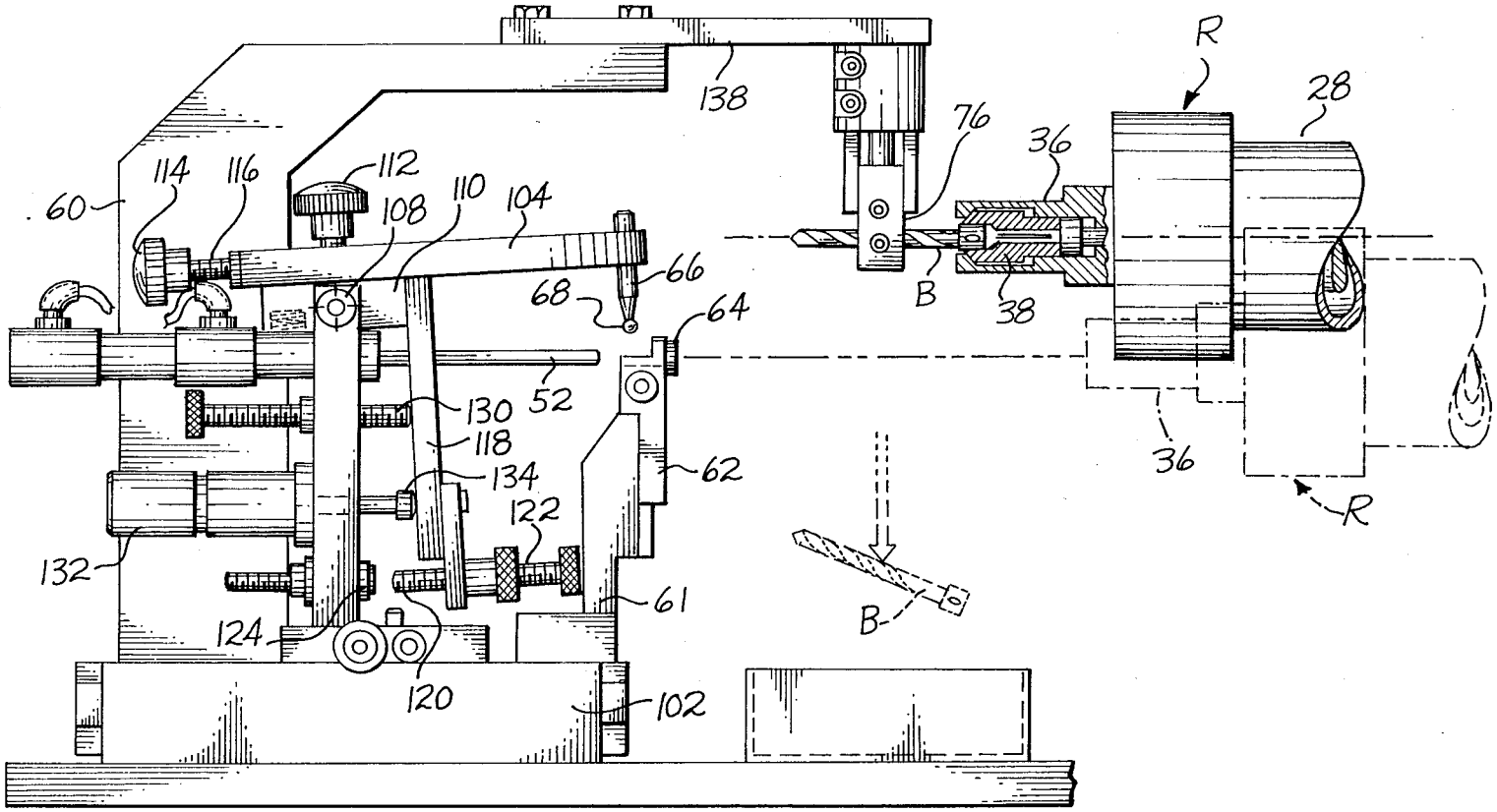
FIG. 18 is a view like FIG. 17, showing the robot arm elevated and the reject gripper clamp about a drill bit that is still positioned in the nosepiece of the robot arm.

In accordance with an aspect of the invention, the system is adapted to detect and reject (1) drill bits B having an excessive amount of material buildup on the drill point, (2) undersized drill bits, and (3) oversized drill bits. In each case, a drill bit B to be rejected is grasped by a gripper 76 while it is in the robot nosepiece 36. Then the nosepiece collet 38 is opened and the robot arm 28 is retracted away from the drill bit B. Then the gripper 76 is opened to release the drill bit B, allowing it to drop into a reject receptacle 78 (FIG. 18).

The reject gripper 76 is mounted on an arm 138 which extends from the top of the standard 60 over a position that is spaced axially outwardly from the position of the outer end of the collet 38 when the robot arm 28 is in its drill bit receiving position. A reject condition causes the robot arm 28 to rise and extend to place the drill bit B between jaws of the gripper 76. As is known per se, the gripper 76 includes a jaw actuating cylinder. When the cylinder is extended, the jaws 140,142 are swung together into tight gripping contact with the drill bit B. Then, the collet 38 in the nosepiece 36 is opened, to release the drill bit B, and the robot arm 28 is retracted away from the drill bit B. Then the jaws 140,142 are swung apart, by retraction of the cylinder, allowing the drill bit B to drop straight downwardly into a receptacle.

If there is an excessive amount of material build-up in the drill bit flute 70, the stylus 66 will not drop down far enough to place the element 120 close enough to sensor 124 to signal that the drill bit B is ready for movement to the sharpening machine 10. This failure of the sensor 124 to produce a ready signal causing the robot arm 28 to retract, raise and then extend to the gripper, and a clamping movement of its jaws on the drill bit B, and an opening of the collet 38, and a retraction of the robot arm 28, and then an opening of the gripper jaws.

If the drill bit B is undersized, this will be sensed at the collet C of the drill bit holder 18. Owing to the undersized condition, the collet C cannot clamp on the drill bit B so it does not receive the drill bit B. The drill bit B stays with the robot arm 28 and is swung back to the drill bit receiving position of the robot arm 28. A sensor LS-P is positioned where it will be in the swing path of the drill bit B (FIGS. 2 and 3). That is, it is positioned slightly outwardly of the swing path of the nosepiece 36 so that no signal is generated during a swinging movement of the arm 28 without a drill bit B in the nosepiece 36. The sensor LS-P is electrically deactivated in the control circuit when the robot arm 28 swings from its drill bit receiving position to its drill bit feeding position. Otherwise the sensor LS-P would detect drill bits B moving to the feed position. The sensor circuit, however, is actuated for robot arm return so that any drill bit return back to the receiving position will be detected. The sensor LS-P may be an inductive proximity type sensor. It is positioned so that a drill bit B in the nosepiece will swing through an electromagnetic field. This breaking of the field will signal the reject gripper 76 to operate when the robot arm 28 reaches its drill bit receiving position. As before, the robot arm is raised and extended to place the drill bit B between the gripper jaws, 140,142. The gripper 76 is operated to clamp onto the undersized drill bit B. Then the collet 38 is opened to release the drill bit B and the robot arm 28 is retracted. Next, the gripper jaws 140,142 open, allowing the drill bit B to fall into the reject receptacle. Then, the robot arm 28 drops and extends to receive another drill bit B.

The third reject condition is an oversize drill bit. This condition is also sensed when the drill bit B is introduced into the collet C of the sharpening machine 10. The collet C detects that the drill bit B is oversize and does not receive the drill bit B. As in the case of the undersized drill bit, the oversized drill bit stays with the robot arm 28 as it swings back to its drill bit receiving position. The drill bit breaks the electromagnetic field and this signals the gripper 76 to operate for removing the drill bit B from the nosepiece 36 when the robot arm 28 reaches its drill bit receiving position.

As previously stated, the particular drill bit carrier that is a part of the illustrated embodiment was constructed by modifying a Seiko Model 700R robot R. This robot R came with the housing or sleeve 30, the extendible-retractable arm 28 and the head and column structure 40, 48 to which the sleeve 30 is attached. The Seiko robot R also came with a vane-type air rotator mounted at the closed end of the housing 30, as previously described.

Figure 23:
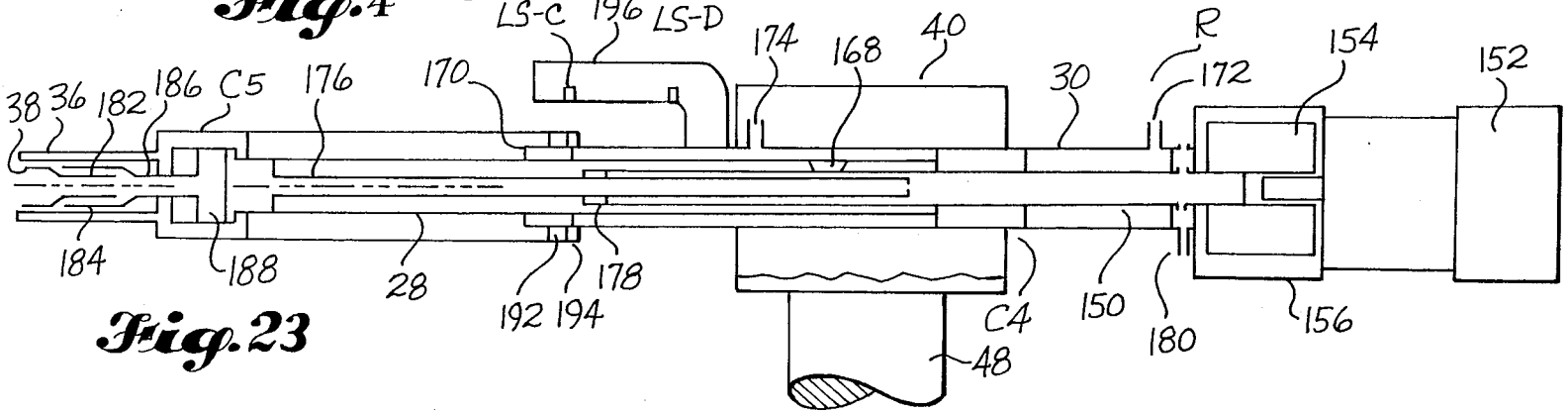
FIG. 23 is a schematic view of the arm assembly.
Figure 7:
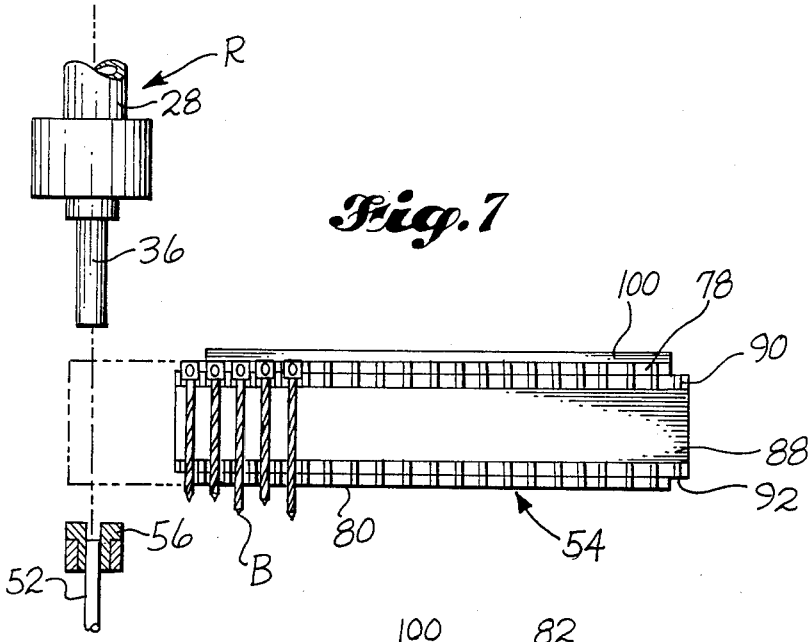
FIG. 7 is a top plan view of the conveyor, the nosepiece end portion of the robot arm and the pushrod used to feed the drill bit into the nosepiece, and a guide structure for the pushrod.
Figure 8:
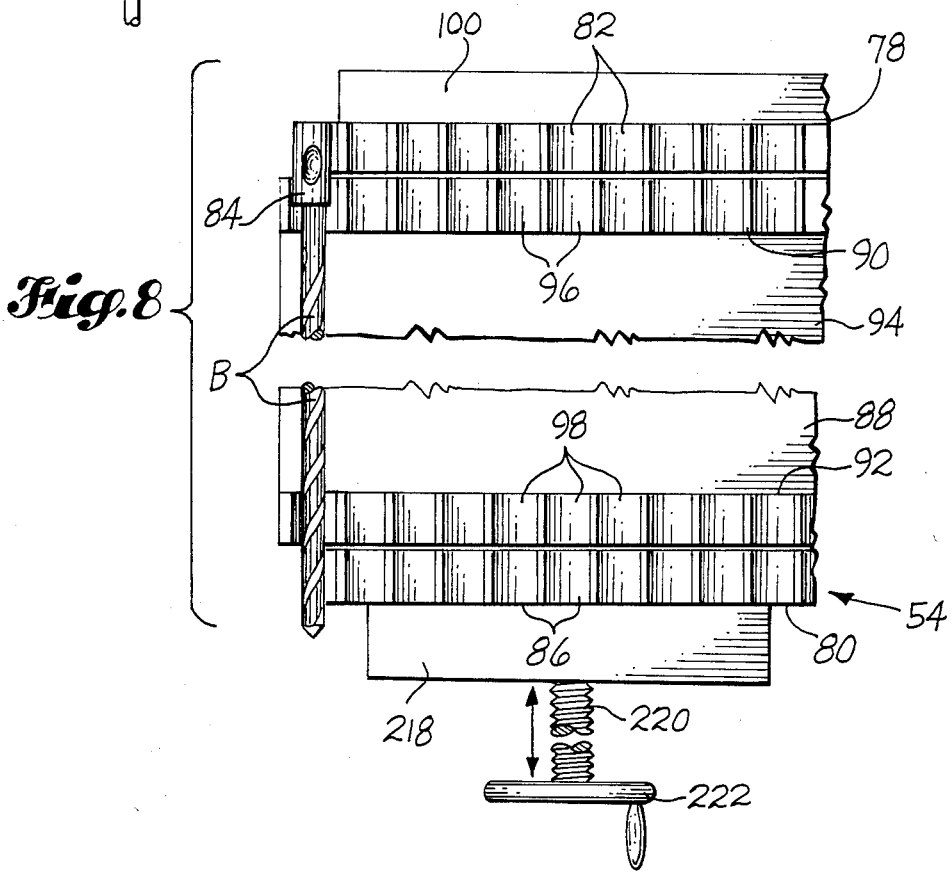
FIG. 8 is an enlarged scale, fragmentary, top plan view of the discharge end of the conveyor.

Referring to FIG. 23, a rotary shaft 150 projected rearwardly from the housing 30 into the air vane housing and the air vane was directly connected to shaft 150 within the housing. In operation, air was introduced into the air vane housing, on one side of the vane. This exerted a force on the vane that caused it to rotate until it contacted a stop (about one hundred and eighty degrees). The rotor 150 was rotated in the opposite direction, by introducing air against the opposite side of the vane. Again the vane and the rotor 150 would rotate until the vane contacted the stop.

Figure 29:
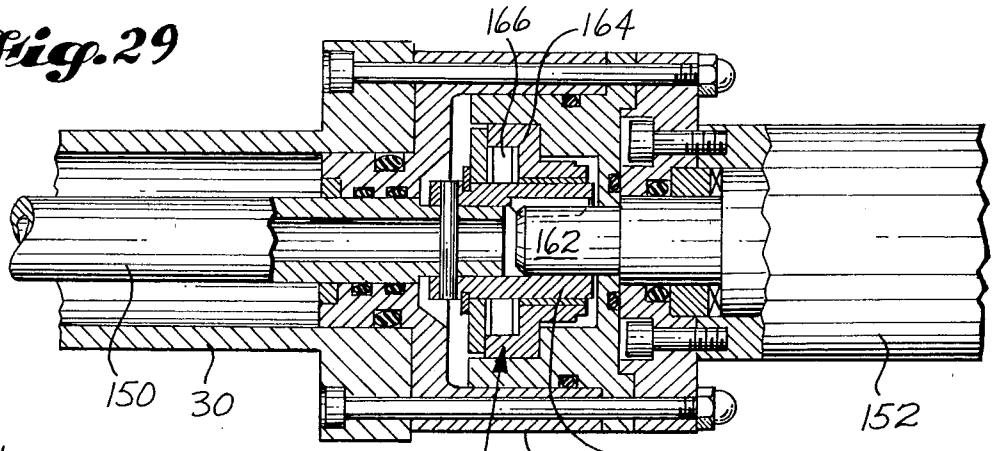
FIG. 29 is a fragmentary axial sectional view, with some parts in elevation, of the rear end portion of the arm assembly.

In constructing the illustrated embodiment, the air vane rotator was replaced by a rotary hydraulic motor 152 and an over running clutch 154. The clutch was a Model FS-04 clutch marketed by Formsprag Company, a division of Dana Corporation, 23601 Hoover Road, Warren, Mich. 48090. The clutch 154 is located in a housing 156 that is attached to the closed end of housing 30. The rear end of shaft 150 extends into the housing 156 and is connected to a connector component or sleeve 158 (FIG. 29) of the clutch. The hydraulic motor 152 is mounted onto the rear portion of housing 156. Motor 152 includes an output shaft 162 which extends forwardly into the housing 156 and connects to the same sleeve 158. This sleeve 158 is surrounded by a larger diameter sleeve 164 that is fixed in position to the clutch housing 156. A plurality of sprags 166 are positioned in an annular space located between the two sleeves 158,164. When the hydraulic motor 152 is rotated in one direction, to rotate a drill bit during its indexing, the sprags 166 slip and the hydraulic motor 152 drives the shaft 150. When the direction of fluid pressure delivery to the hydraulic motor 152 is reversed, the sprags 166 immediately and quickly lock in position between the fixed outer sleeve 164 and the rotatable inner sleeve 158. This immediately stops the inner sleeve 158 and the shaft 150 from rotating. The pressure build-up in the delivery line to the hydraulic motor 152 is relieved by way of a relief valve, in a known manner.

The rotor 150 extends forwardly from the clutch 154, through the interior of the housing 30. The rearward portion of the arm 28 surrounds the shaft 150 and at its rear end is connected to an annular piston which both slides on the shaft 150 and makes sliding contact with the interior of the housing 30. The arm 28 carries a radially inwardly projecting key 168 which is received within a longitudinal key slot (not shown) formed in the outer surface of the shaft 150. This allows the arm 28 to reciprocate along the shaft 150, and at the same time rotate with the shaft 150. A seal 170 is provided at the outer end of the housing 30, for sealing between it and the arm 28. Air pressure is introduced into port 172 and relieved through port 174, to extend the arm 28. Pressure is introduced into port 174 and relieved from port 172 to retract the arm 28.

The Seiko robot came with an air cylinder at the front end of the arm 28, adopted to actuate a gripper. This air cylinder was removed and replaced with a new air cylinder C5. Cylinder C5 is secured to the outer end of the arm 28. An air delivery pipe 176 is connected at its forward end to an inlet fitting for the cylinder C5. The tube 176 extends rearwardly from the cylinder C5 and into the center of the shaft 150. There is a telescopic engagement between the shaft 150 and the tube 176, during the full range of movement of the arm 28. A seal 178 is provided at the outer end of the shaft 150, to seal between it and the tube 176. Air may be introduced into the shaft 150 in any suitable manner. For example, a swivel type manifold 180 may be provided at the closed end of the housing 30.

Referring to FIG. 23, the collet 38 inside of nosepiece 36 includes a rear portion 182 which projects into a forward portion 184 of an actuator 186 which is connected at its rear end to a piston 188 in the air cylinder C5. When air is introduced against the backside of the piston 188, the piston 188 and the actuator 186 move axially forwardly. The axial movement of the actuator's front portion 184 causes it to exert a squeezing force on the collet 38, moving the collet jaws into tight squeezing contact with the shank of a drill bit B that has been placed in the collet 38. When air pressure is removed from the backside of the piston 188, the squeezing pressure is relieved, enabling the drill bit B to be removed from the collet 38. A return spring (not shown) may be used for retracting the piston 188.

As will hereinafter be explained in greater detail, the collet 38 is designed so that it does some frictional gripping of the drill bit B even when the collet 38 is open. This is done so that the drill bit B will stay in the collet 38 until and unless it is forceably removed from the collet 38. For example, if there is an undersized drill bit B in the collet 38, such drill bit B will not be grasped by the collet C in the drill bit holder of the sharpening machine 10. As a result of the frictional grip of collet 38 on the drill bit B, the drill bit B will stay with the arm 28 as the arm is retracted away from the drill bit holder 18.

Figure 27:
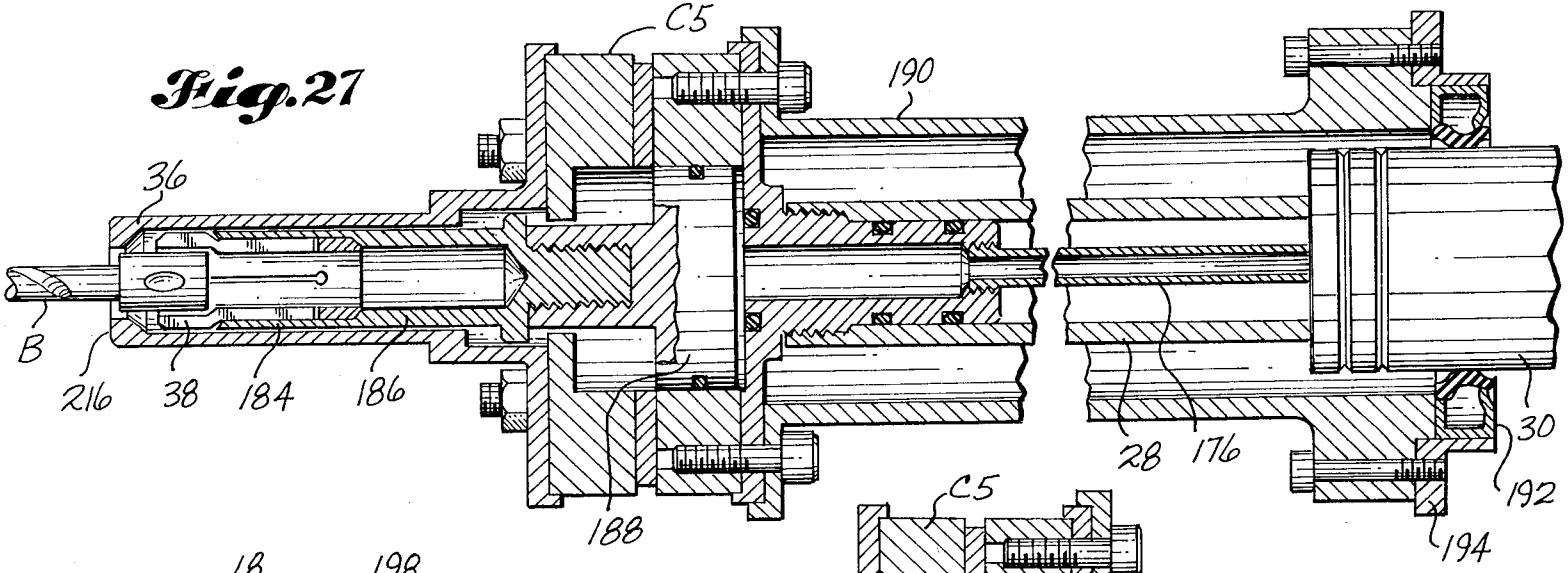
FIG. 27 is an enlarged scale axial sectional view of the nosepiece end of the robot arm assembly, with some parts shown in elevation and other parts cut away to indicate indeterminate length, such view showing the carrier collet in an open position and a shank portion of a quick change drill bit frictionally held by such collet.

Another modification of the Seiko robot R, involved the addition of a sleeve 190 which is connected at its forward end to the cylinder C5, to extend axially rearwardly therefrom, concentric with the arm 28. Sleeve 190 carries a wiper ring 192 (FIG. 27) at its rear end, which makes contact with the outer surface of the housing 30. The wiper ring 192 is housed within a steel ring 194. A sensor mounting arm 196 (FIG. 23) is clamped onto the housing 30. Arm 196 includes a horizontal portion which projects forwardly and carries two axially spaced apart sensors, LS-C and LS-D. During extension of the arm 28, the sensor LS-C detects the ring 194 when it reaches a predetermined position. The sensor LS-C then sends a signal which stops further extension and signals the control circuit that such position has been reached. In similar fashion, as the arm 28 is retracting, the ring 194 moves into a position of proximity with the sensor LS-D. When ring 194 reaches a predetermined position, the sensor LS-D produces a signal which is used to stop the arm 28 from retracting any further.

Figure 28:
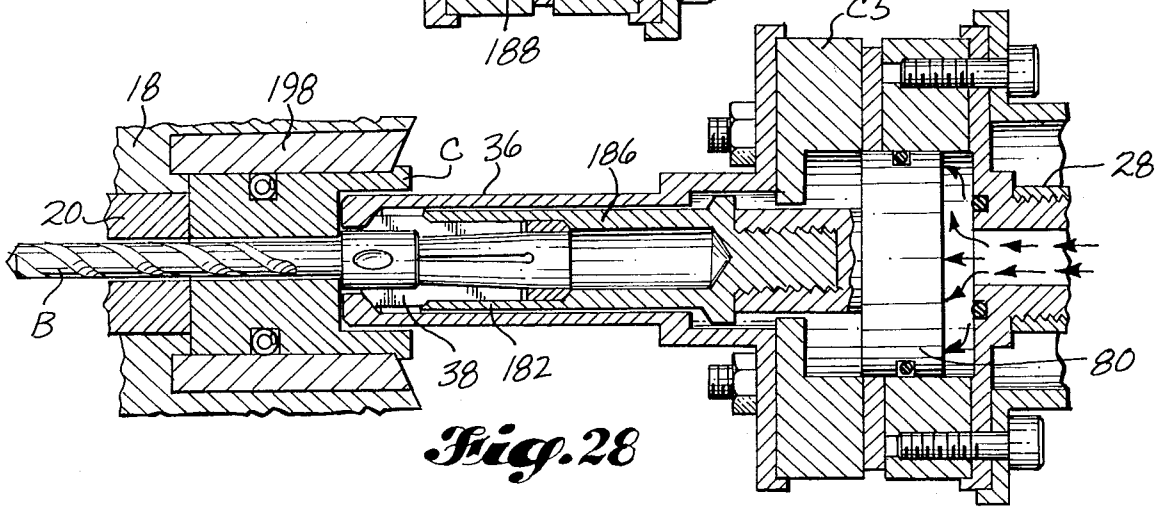
FIG. 28 is a view like FIG. 27, but with the rear portion of the view omitted, and showing air being delivered into an air cylinder, for moving a collet actuated forwardly, to exert an inward squeezing pressure on the carrier collet, for the purpose of closing such collet tightly around the shank of the drill bit, such view showing the drill bit in the holder collet and bushing, and further showing the outer end of the nosepiece within a well in the outer end portion of the holder collet, and the end surface of the nosepiece in close proximity to a gauge surface on the holder collet.

FIG. 28 shows a drill bit B in the collet 38 and shows the end portion of the nosepiece 36 positioned in a center well formed in the outer end portion of a collet C. As earlier stated, a different collet C is used for each size of drill bit B (see FIGS. 32–39). The outside configuration and dimension of all the collets C are identical. The collets C are adapted to be easily slipped into and out from a larger collet 198 which is a part of the holder 18 of the sharpening machine 10.

Figure 30:
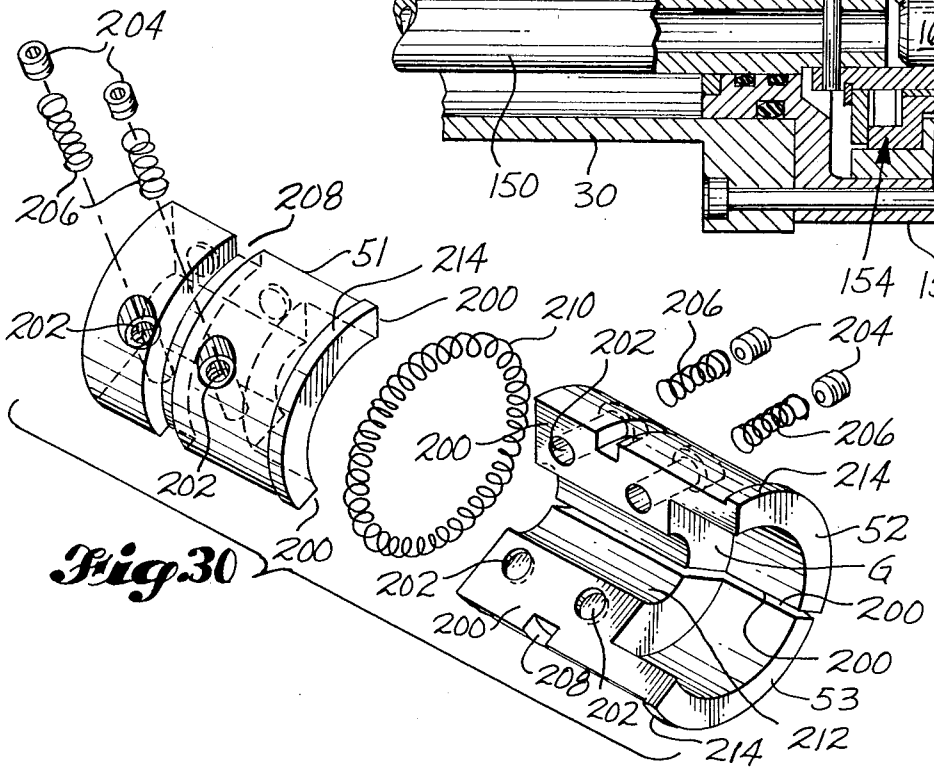
FIG. 30 is an exploded isometric view of a holder collet.

Referring to FIGS. 30 and 31, in preferred form, each size collet C comprises three segments S1, S2, S3. Each segment S1, S2, S3 includes a pair of axial surfaces 200 spaced one hundred and twenty degrees (120°) apart. The collet segments S1, S2, S3 are each drilled, at two axial stations, to provide spring sockets 202 extending perpendicular to the surfaces 200 (FIG. 31). The outer ends of the spring sockets 202 are closed by set screws 204. Springs 206 are positioned in the sockets 202. The springs 206 are longer than the sockets 202. They project out from the sockets 202 and make contact with a portion of the adjacent segment.

Segments of an annular groove 208 are formed in the outer side portions of the outer segments S1, S2, S3, axially between the two sets of spring sockets 202 and springs 206. An O-ring 210 fits within the groove 208, and serves to band the collet segments S1, S2, S3 together. When the collet segments S1, S2, S3 are together, the springs 206 urge the segments S1, S2, S3 apart, creating axial spaces between the adjoining surfaces 200 of the segments S1, S2, S3 (FIG. 30). Each segment S1, S2, S3 is formed to include a segment of a center passageway 212 into which the drill bit B is received.

Each segment S1, S2, S3 is formed to include a segment of an annular lip 214 which functions as a stop, so that the collet C can be inserted into the larger collet 198 and pushed forwardly until the lip 214 makes contact with an end portion of the larger collet 198.

The employment of two sets of springs 206, and the location of the O-ring band 210 between the sets of springs 206, causes the collet segments S1, S2, S3 to occupy substantially parallel positions as they move in and out. As will be evident, the segments S1, S2, S3 can be moved inwardly until contact is made at the surfaces 200. In normal operation, the arcuate inner jaws of the segments S1, S2, S3 will make gripping contact with an intermediate portion of a drill bit B before the surfaces 200 meet. If the surfaces 200 meet, and the drill bit B has not been gripped, this means that the drill bit B is undersized.

The larger collet 198 in the holder 18 functions to exert a squeezing force on the segments S1, S2, S3, moving them together, in opposition to the forces exerted by the springs 206. When this squeezing action of the larger collet 198 is released, the springs 206 function to move the collet segments S1, S2, S3 apart.

FIGS. 32–39 illustrate eight different sizes of collets C, designated C1–C8. Each collet is designed for a different sized drill bit. Each collet includes a gauge surface G at the outer end of the collet. This gauge surface G is used for positioning the arm assembly 28, 30 relative to the collet. The collet shown by FIGS. 32–34 include outer end sockets and the gauge surface is the base surface of the socket. FIG. 35 shows the gauge surface as a planar outer end surface of the collet C4. FIGS. 36–39 show an outer end extension on the collets C5–C8 and the location of the gauge surface at the outer end of the extension.

The gauge surface G is used in the following manner. The bolts 46 is the top section 42 of the head structure 40 are loosened or removed, to relieve the clamping pressure on the housing 30. Then, with the arm 28 in its fully extended position, the housing 30 is shifted into position until the outer end surface 216 on the nosepiece 36 almost touches the gauge surface G of the particular collet C that is within the drill bit holder 18. Then, the bolts 46 are tightened, to clamp the housing 30 in this particular position.

As will be evident from an inspection of FIGS. 32–34, with some size drill bits B it is necessary to place the end surface 216 of the nosepiece 36 closer to the grinding wheel than will be permitted by the normal outer end of the collet C. In these situations, the outer end portion of the collet is provided with a well into which the forward end portion of the nosepiece 36 can extend. The provision of the well, allows the system of the invention to be used with shorter drill bits than would be the case if the well were not provided.

The endwise adjustment of the arm assembly 28, 30, for the purpose of endwise positioning the drill bit for proper contact with the grinding wheel 14 during the grinding cycle is accompanied by other adjustments at the drill bit receiving position of the arm assembly 28, 30. The projected length of a drill bit B out from the end of the nosepiece 36 is a predetermined length. It is selected such that when the arm 28 has been extended to insert the drill bit B into the drill bit holder 18, the tip of the drill bit B will essentially contact the stop 22 (FIG. 24). As earlier stated, the projected length of the drill bit B out from the end of the nosepiece 36 is determined by the amount of extension of the push rod 52.

Endwise positioned adjustment of the arm assembly 28, 30 makes necessary a sideways adjustment of the conveyor 54. As diagramatically shown by FIG. 8, the support base 218 of the conveyor 54 is mounted for back and forth sideways movement and is so moved by turning a handle 222 on a lead screw 220.

The sequence of operation will now be described, first with reference with block diagrams (FIGS. 41–47), and then with reference to the system and circuit diagrams (FIGS. 48–50D).

The control system interconnects (1) the conveyor operation, (2) the loading operation, (i.e. drill bit movement off from the conveyor into the collet of the carrier), (3) the drill bit indexing operation, (4) carrier movement and operation, including insertion of the drill bits into the grinding machine, (5) the various reject operations, and (6) the grinding operation performed by the grinding machine.

Figure 42:
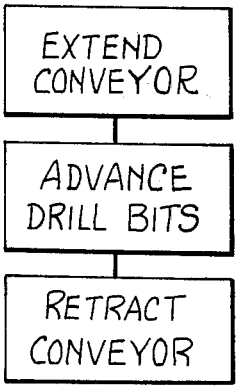
FIG. 42 is a block diagram of the conveyor functions.

Referring to FIG. 42, the conveyor must both lift and extend in position and advance the drill bits one position. These steps may be performed simultaneously. Following removal of the drill bit from the end position on the conveyor, the conveyor must be retracted.

Figure 43:
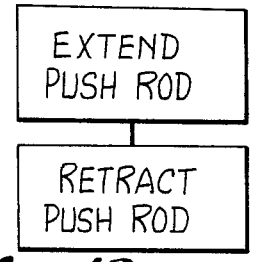
FIG. 43 is a block diagram of the carrier loading operation, i.e. movement of the drill bit off of the conveyor and into the carrier collet, but not including the collet control.

Referring to FIG. 43, the pushrod must be extended for the purpose of pushing the drill bit from its end position on the conveyor, into the collet in the nosepiece of the carrier. Then, the pushrod must retract.

Figure 44:
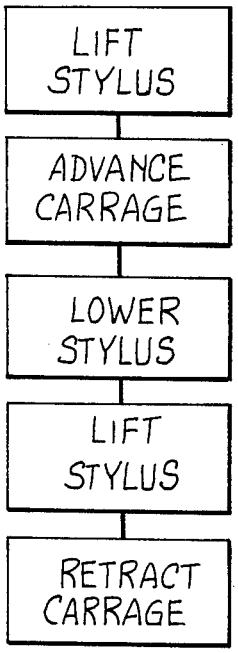
FIG. 44 is a block diagram of the indexing operation, but not including the collet control.

Referring to FIG. 44, the stylus must be lifted up into an elevated position, the carriage for the stylus and the support bushing must be advanced with the stylus in its up position, then the stylus must be lifted again and the carriage must be retracted while the stylus is up.

Figure 45:
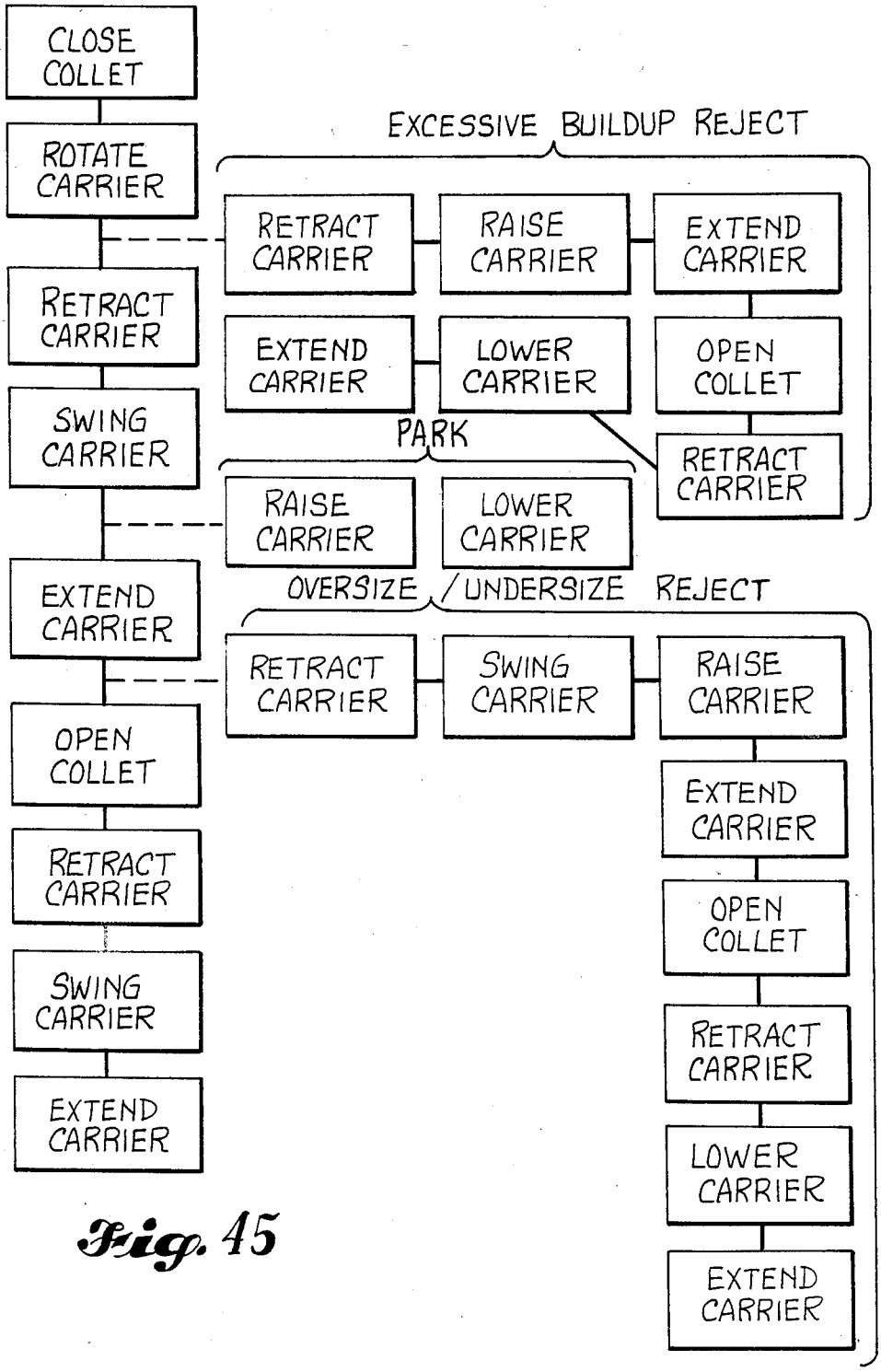
FIG. 45 is a block diagram of the carrier operation, including its function in the loading, indexing and reject operations.
Figure 48:
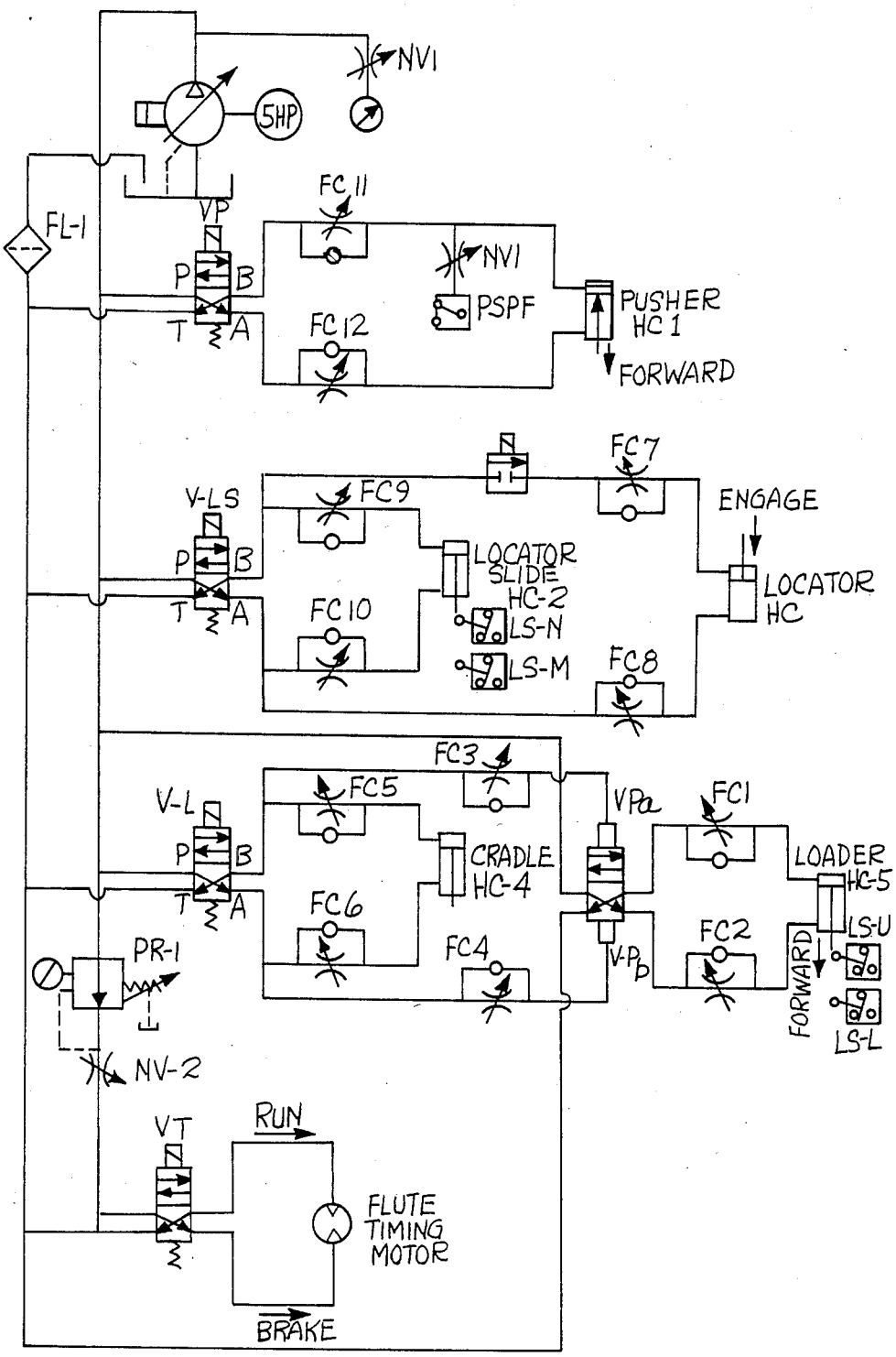
FIG. 48 is a schematic diagram of the hydraulic system.
Figure 49:
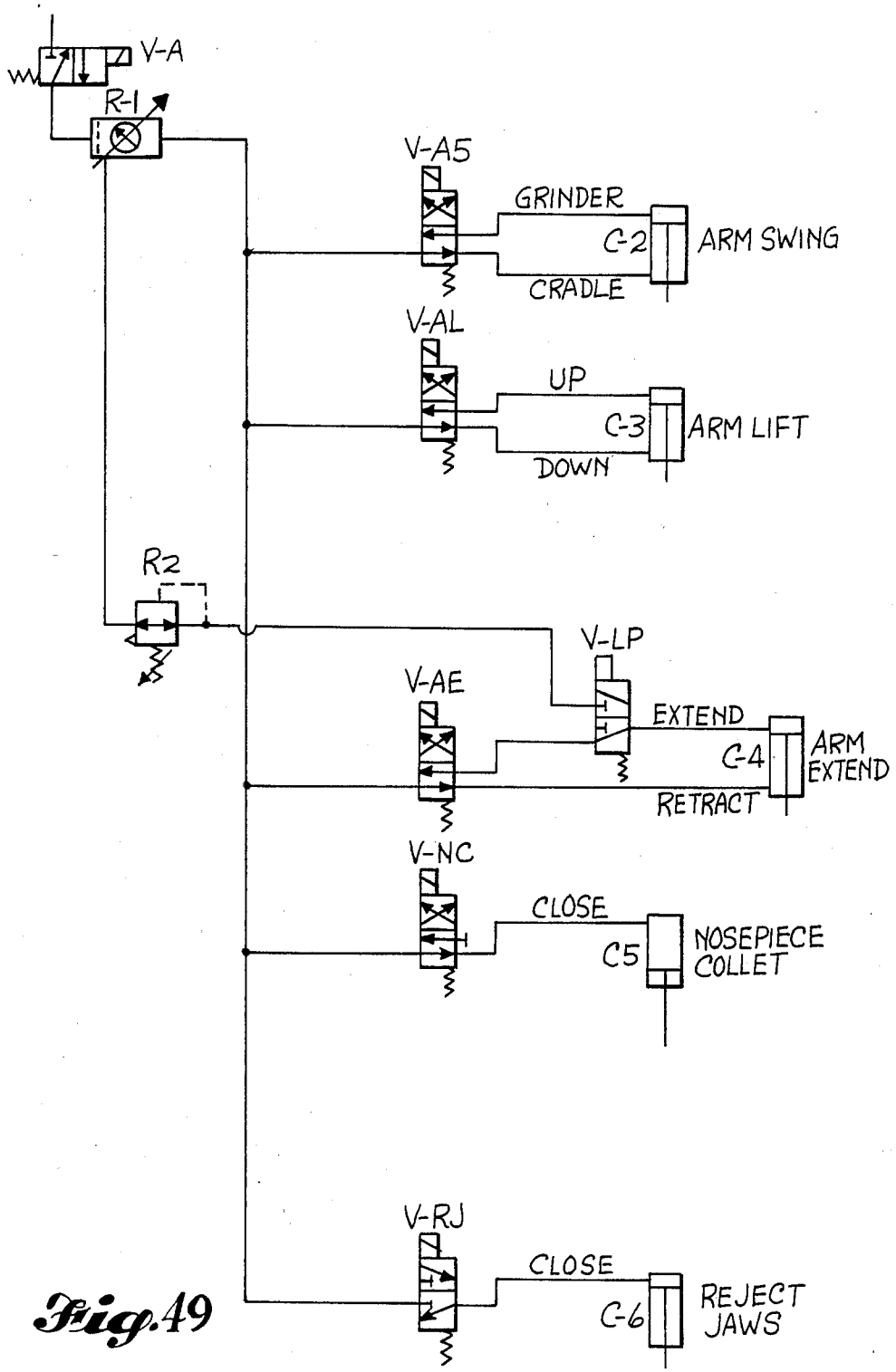
FIG. 49 is a schematic diagram of the pneumatic system.

Referring to FIG. 45, the collet in the carrier is closed about the shank of the drill bit into the collet. Then, the collet is rotated about its axis during indexing. If an excessive build-up of material in a drill bit flute is detected during indexing, the carrier is retracted then raised and extended to place the drill bit between the jaws of the gripper. After the drill bit is gripped the collet is then opened to release its hold on the drill bit. Then the carrier is retracted away from the drill bit and lowered, and then extended again to receive the next drill bit. If a drill bit is a good one, the carrier is retracted at the end of indexing and is then swung into a drill bit inserting position. If it has to wait for the completion of a grinding cycle, or for the grinding wheel to be dressed, it is moved upwardly into a park position and stays there until the grinding machine is ready to receive the drill bit. Then, the carrier is lowered and extended.

If the grinding machine is ready to receive the drill bit when the carrier reaches the end of its swing stroke, the carrier is immediately extended to place the drill bit into the drill bit holder of the grinding machine. If the drill bit is either oversized or undersized, this is detected. The carrier is retracted and swung back into its first position. It is then raised and extended to place the drill bit between the jaws of the reject gripper. After the drill bit is gripped, the collet is opened and the carrier is retracted away from the drill bit and then lowered. It is then extended into a position to receive the next drill bit.

If the drill bit is of a proper size, this will be detected at the drill bit holder and the carrier collet is opened to release its hold on the drill bit. The carrier is then retracted and is swung in position and extended to be ready to receive the next drill bit.

Figure 46:
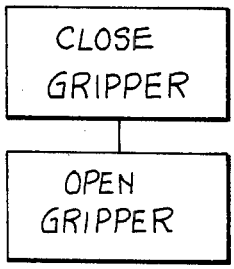
FIG. 46 is a block diagram of the reject operation, minus the functioning of the carrier in such operation.

Referring to FIG. 46, the jaws of the gripper are closed about the drill bit, after the drill bit has been positioned between the jaws. Then, following retraction of the carrier, the gripper is opened, to allow the drill bit to drop into a receptacle positioned below the gripper.

Figure 47:
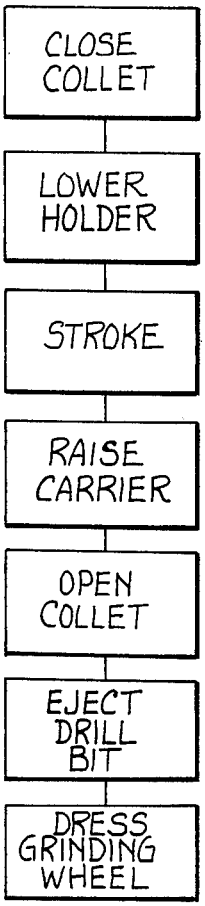
FIG. 47 is a block diagram of the sharpening machine operation.
Figure 40:
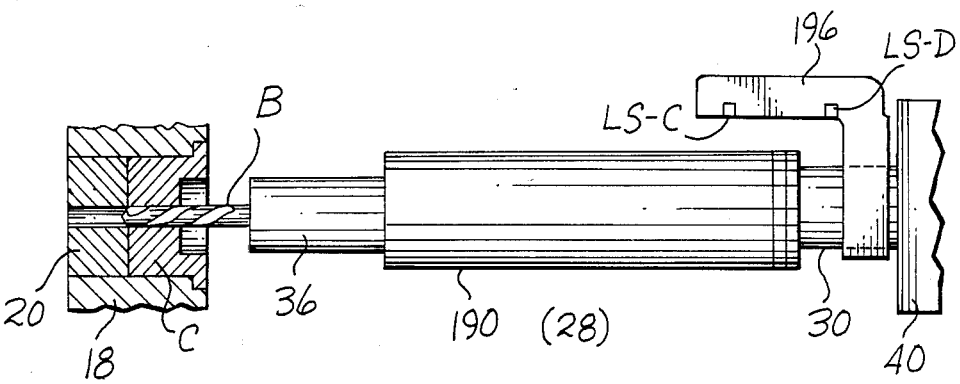
FIG. 40 is a schematic view of an oversized drill bit positioned in contact with the bushing in the holder, and showing the manner in which it prevents the arm from being extended into its fully extending position.
Figure 41:
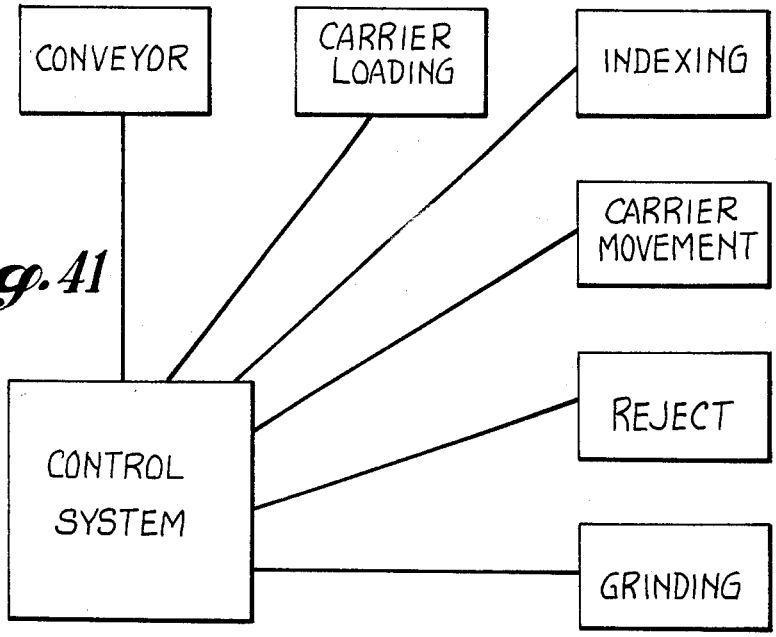
FIG. 41 is a block diagram showing an association of the control system with the basic functions of the complete system.

Referring to FIG. 47, if the drill bit holder of the sharpening machine receives a drill bit insertion signal from the robot, the collet of such holder is closed about the drill. Then, the holder is lowered to place the drill bit point against the grinding wheel, and the holder is driven to move the drill point through a sharpening stroke. Following sharpening, the holder is raised and the collet of the holder is opened, to release its hold on the drill bit. An eject pin is extended to push the drill bit out of the holder and into the upper portion of the discharge chute which lead down to a collection receptacle. After a certain number of sharpening operations, the sharpening machine is operated to dress the grinding wheel.

The control system used to operate the automatic feed mechanism, and to coordinate its operation with the operation of the sharpening machine, for the purpose of converting the sharpening machine from semi-automatic to compeletly automatic operation, is basically a event sequence system with relays which are activated by position signals from the various components of the feed mechanism. In the control diagram the various position sensors are labeled "LS", for limit switch. However, the particular type of sensor that is used is not important. It is only necessary that the sensor be capable of producing a control signal in response to an element with which it is associated reaching a predetermined position. Sensor 124 is a part of a proximity switch that is actuated by the proximity of screw 122 to the end of the sensor 124. The switch is a highly sensitive switch which is actuated without direct engagement of the screw 122. It is actuated when the gap between the end of the screw and the end of the sensor closes to a predetermined dimension which can be set very precisely. One known switch of this type is a Transistorized Proximity Switch, sold commercially by Electro Products Laboratories, 6125 W. Howard St., Chicago (Niles), Ill., and advertised as being manufactured under U.S. Pat. Nos. Re. 24,779 and 2,922,880. This type of switch is conventionally used as a sensitive limit switch for positioning controls.

The disclosed embodiment includes the following limit switches. Limit switch LS-A is positioned to determine and signal the arm assembly 28, 30 reaching its drill bit inserting position (swing movement). Limit switch LS-B is actuated when the arm assembly is in its down position. Limit switch LS-C determines and signals the arm reaching its extended position. LS-D determines and signals the arm 28 reaching its retracted position. LS-E is actuated when the arm reaches its up position. LS-F determines and signals the arm assembly 28, 30 reaching its drill bit receiving position (swinging movement).

LS-L is actuated when the conveyor 54 reaches its extended position. LS-M is actuated when the carriage 102 (or locator slide) for the stylus 66 and the bushing 64 reaches its extended position. LS-N is actuated when the carriage 102 reaches its retracted position. LS-P is an electromagnetic field sensor. It is actuated when an undersized drill bit is swung through its field (FIGS. 2 and 3). LS-S is actuated when the support table 26 for the robot R is in its in-use position (FIGS. 2 and 3). It operates to shut down the automatic feed system if robot table 26 is not in a proper in-use position. LS-T is actuated when the drill bit holder 18 of the sharpening machine is in its up position. This sensor is connected with the control for the drill bit ejector, so that the drill bit ejector will not extend if the drill bit holder is in any position other than a raised position, with the drill bit in alignment with the ejector rod.

There are many different types of position sensors or limit switches which may be used, and many different variations in their placement are possible. For that reason, with the exception of the proximity sensors 124, LS-C and LS-D, and the electromagnetic field sensor LS-P, the physical placement of the sensors for limit switches is not shown in the structural drawings.

The hydraulic and pneumatic schematic diagrams (FIGS. 48, 49) are for the most part self-explanatory and require little description. A two positioned control valve V-P determines the direction of movement of the hydraulic cylinder HC-1 (FIGS. 12, 13, 17 and 18) which moves the push rod 52. Pressure operated switch PS-PF is actuated by the pressure build-up in cylinder HC-1 which results when the cylinder HC-1 bottoms out.

A directional valve V-LS determines the direction of hydraulic pressure application to a cylinder HC-2 (FIG. 12) which extends and retracts the carriage 102 for the stylus 66 and the bushing 64. This same valve V-LS determines the direction of fluid pressure application to the cylinder HC-3 (FIG. 12) which raises and lowers the stylus. V-LC is an on-off valve.

Direction valve VL controls the direction of fluid pressure application to a cylinder HC-4 (not shown) which operates the lifter to advance drill bits on the walking beam conveyor. The direction valve V-L and its slave valve V-PA/V-PB control the direction of fluid application to a cylinder HC-5 which extends and retracts the conveyor (FIGS. 5 and 6).

A pressure reduction valve PR-1 is positioned in the pressure line leading to the hydraulic motor 152. A direction valve V-T controls the direction of pressure application to motor 152.

The pneumatic system includes an on-off valve V-A and regulators R-1 and R-2. A directional valve V-AS controls the direction of pressure application to cylinders C-2 which swings the arm assembly 28, 30 (FIG. 19). The directional valve V-AL controls the direction of fluid pressure application to a cylinder C-3 (FIG. 20) which lifts and lowers the arm assembly 28, 30. V-LP and V-AE control the direction of fluid pressure application to cylinder C-4 (FIG. 23) which extends and retracts the arm 28.

V-FC controls the supply of fluid pressure to the single acting cylinder C-5 (FIG. 23) which activates the collet 38. V-RJ controls the supply of fluid pressure to a single acting cylinder C-6 which functions to close the jaws of the reject gripper.

The electrical control circuit (FIGS. 50A–50D) is also substantially self-explanatory. This diagram includes some control panel switches which are shown but not labeled in FIG. 1, as such labeling will serve no useful purpose. An operational sequence follows, with reference to the control circuit diagram, and including some reference to the previously described structural figures of the drawing.

In preparation for the start of automatic operation, the following settings are made on the grinder control panel (FIG. 1). The pace setter is turned off. The automatic dresser is turned on. The spark out counter and the auto dresser counter are set per the manual furnished by the manufacturer of the grinder (e.g. Winslow). The machine start-button is pushed to start. The grinding wheel on-button is pushed to start rotation of the grinding wheel 14. The coolant on button is pushed to start the flow of the coolant.

Figure 50A:
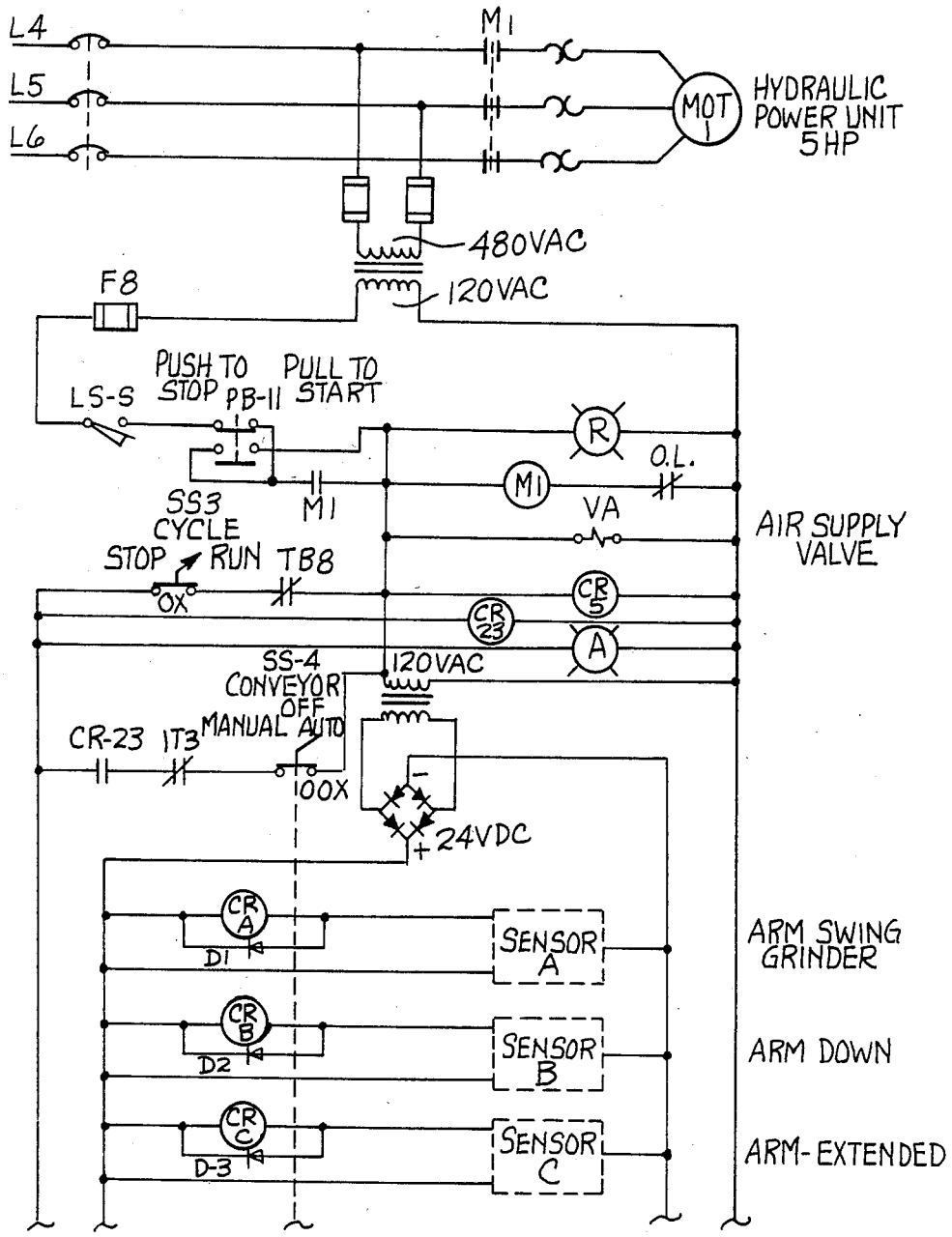
FIGS. 50A, 50B, 50C and 50D together constitute a schematic diagram of the electrical part of the control system.
Figure 50B:
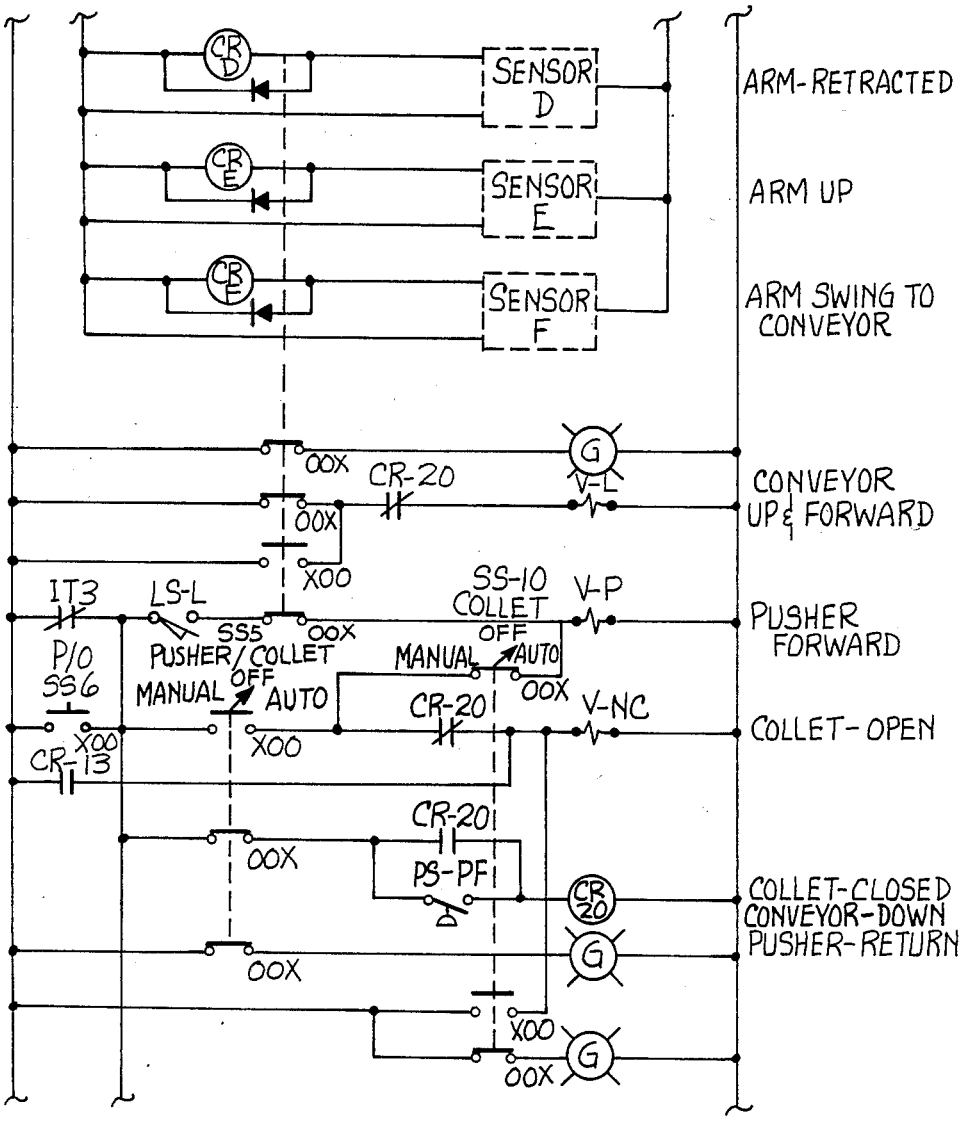
Figure 50C:
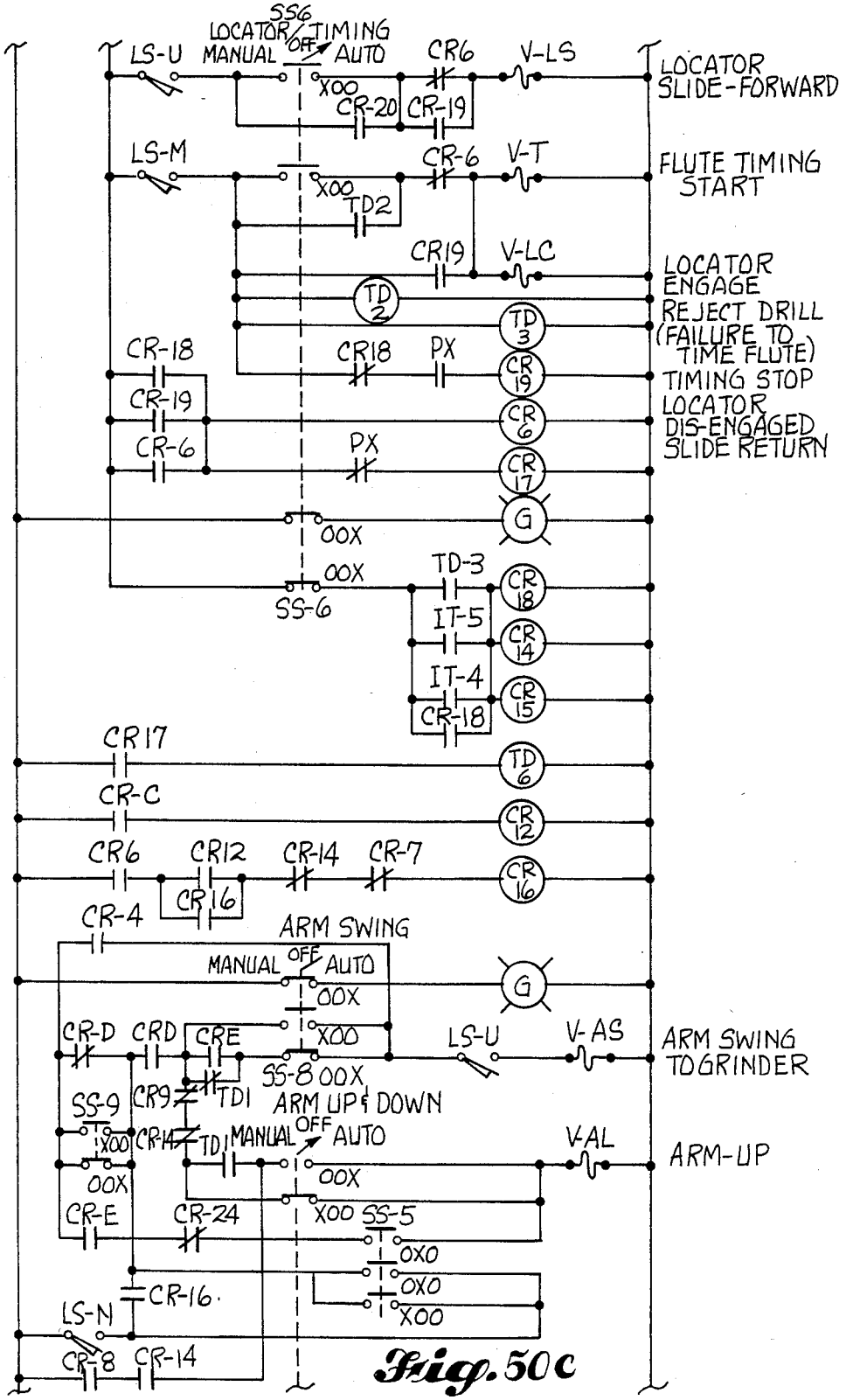
Figure 50D:
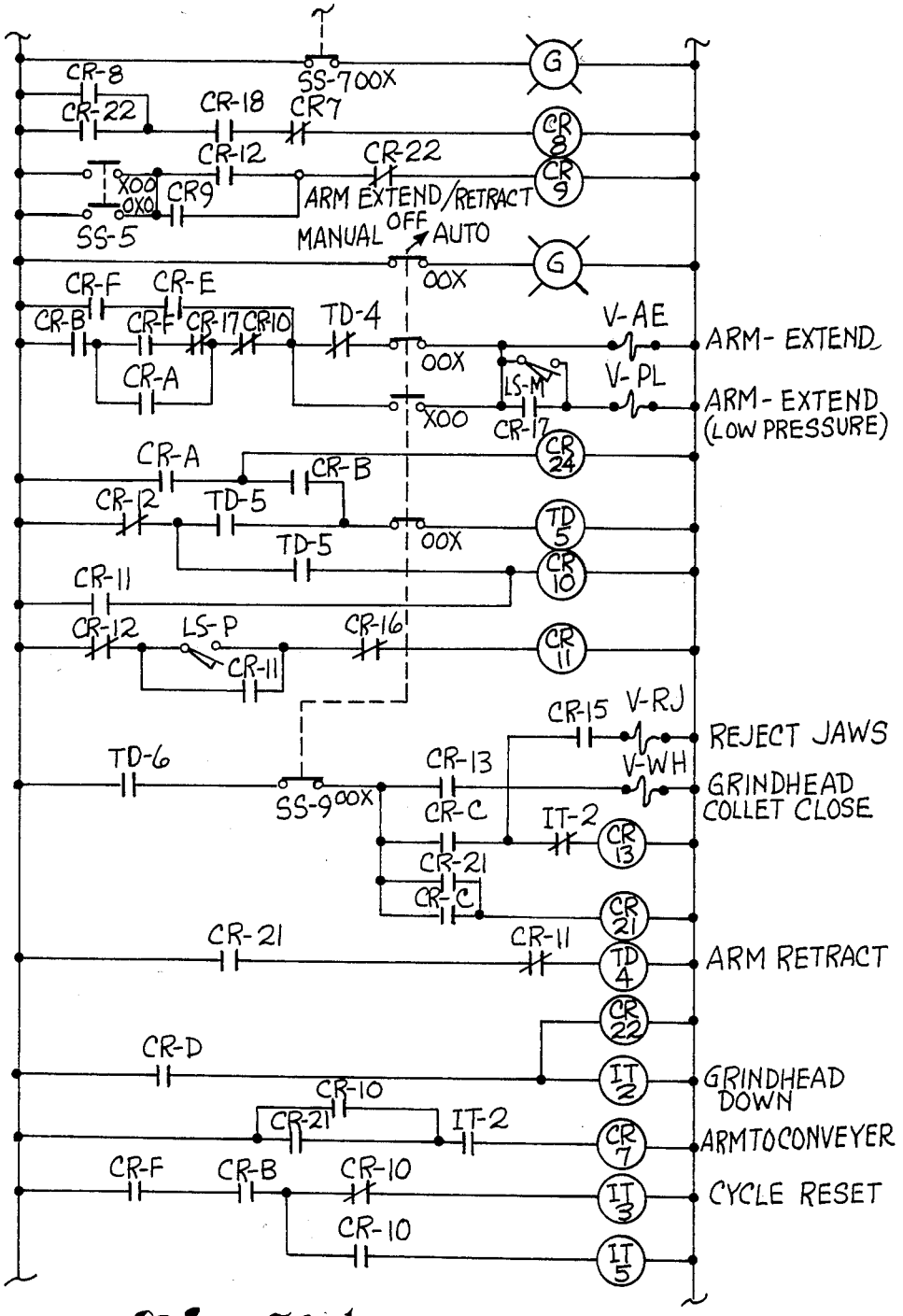

Referring to FIGS. 50A–50D, the following settings are made on the automatic feed control panel (FIG. 1). The cycle switch SS-3 (FIG. 50A) is turned to "stop." The collet switch SS-10 is turned to "automatic" (FIG. 50B). The conveyor switch is set on "automatic" (FIG. 50A). The pusher/collet switch SS-5 is set on "automatic" (FIG. 50B). The locator/timing switch SS-6 is set on "automatic" (FIG. 50C). The arm up and down switch is turned to "automatic" (FIG. 50C). The arm/swing shift is set on "automatic" (FIG. 50C). The arm extend and retract switch is set on "automatic" (FIG. 50D). The pull to start switch PB-11 is pulled. Next, the cycle switch SS-3 is turned to the "run" position (FIG. 50A).

At the beginning of the automatic cycle, the conveyor 54 moves upwardly and forwardly and the lifter 88 moves upwardly and forwardly. This activates limit switch LS-L. Actuation of LS-L causes the carrier collet 38 to open and the push rod 52 to extend, moving a drill bit B from the conveyor 54 into the carrier collet 38.

When the push rod 52 becomes fully extended, pressure switch PS-PF is actuated. This causes the carrier collet 38 to close, the push rod 52 to retract, and the lifter 88 and the carrier 54 to move down and retract, actuating limit switch LS-U. Actuation of LS-U causes the carriage 102 (locator slide) and the indexing or locator mechanism carried thereby to move forwardly, activating limit switch LS-M. Activating LS-M causes the drill bit B to rotate, and causes the locator ball 68 to lower and contact the drill bit B. When the locator ball 68 drops into the bottom of a flute 70 of the drill bit B, the proximity sensor 124 is actuated. This causes a reversal of fluid pressure to the hydraulic motor 152, causing the clutch 154 to operate to stop rotation of the drill bit B. The locator ball 68 is lifted and the locator assembly and the robot arm 28 are retracted.

Retraction of the locator assembly and the robot arm 28 actuates limit switchs LS-N and LS-D, respectively, causing the robot arm assembly 28, 30 to swing into its drill bit insertion position and actuate limit switch LS-A.

If the drill bit holder 18 is not ready to receive a drill bit, the robot arm assembly 28, 30 will move up during its swing, into its "park" position. This actuates limit switch LS-E. The arm assembly 28, 30 will stay in the "park" position until the grinding or dressing cycle is completed by the sharpening machine. The assembly 28, 30 will then move down into its down position, actuating limit switch LS-B.

Actuation of LS-A and LS-B causes the robot arm 28 to extend and deliver the drill bit B into the holder collet C. When the robot arm 28 is fully extended, limit switch LS-C is actuated. The holder collet C closes down on the drill bit B. The carrier collet 38 releases the drill bit B. The robot arm 28 retracts, actuating limit switch LS-D. This starts the grinding cycle.

During the grinding cycle the robot arm 28 returns to its drill bit receiving position, actuating limit switch LS-F. This resets the circuit and a new cycle begins.

In the grinding cycle, the drill bit holder 18 lowers to the grinding-wheel position to grind the drill bit point for a predetermined time. Then the holder 18 returns to its raised position. The holder collet C opens, and the eject pin 24 extends and discharges the drill bit B from the holder collet C, into the ejection chute 72. The drill bit slides down into a receiving receptacle (not shown).

For a long grinding cycle, the robot arm 28 waits at its "park" position until the grinding cycle is completed. Then the robot arm 28 continues its cycle. For a short grinding cycle, the drill bit holder 18 waits at its drill bit eject position until the robot arm 28 inserts a drill bit B and retracts. Then the grinder and robot cycles continue.

As previously stated, occasionally a drill bit cannot be properly timed because of material build-up at the point. The drill bit continues to rotate in the locator bushing 64 and the ball locator 68 does not have sufficient downward travel to actuate the proximity sensor 124. The circuit is designed to include a timed delay device TD-3, which allows a preset amount of time to accomplish the timing function. If this time interval elapses, the robot arm 28 will retract the drill bit from the locator bushing 64. The arm 28 will then raise and extend the drill bit into the jaws of the reject gripper 76. The jaws then close down on the drill bit, the holder collet 38 opens, and the arm 28 retracts (FIG. 18). The gripper jaws then open, allowing the drill bit B to fall into a reject receptacle 78. The robot arm will then lower and extend to begin a new cycle.

Occasionally there will be a small amount of material build-up at the point, but not enough to upset the timing function, but enough to prevent the drill bit from passing through the grinding head bushing. A built-in preset time is provided by a time-delay device, TD-5. If the time has elapsed and the drill bit B has not yet been fully inserted into the holder 18, the robot arm 28 retracts the drill bit from the holder 18. Arm 28 takes the drill bit B to the reject station where the reject process described above is carried out. This material build-up is a type of oversized drill bit condition.

An undersized drill bit will be to small to be clamped by the holder collet C. As a result, the robot arm will retract with the drill bit still in place. The drill bit B stays with the carrier collet 38 even though the collet has been opened because of the friction fit between the drill bit and the carrier collet. As the arm 28 swings back into its drill bit receiving position, the undersized drill bit B is moved through the field of the sensor LS-P (FIGS. 2 and 3) this activates the reject circuit, sending the undersized drill bit to the reject station.

If the holder 18 should fail to return to its fully up position, limit switch LS-T will prevent the drill-eject pin 24 from extending and will send the carrier held drill bit to the reject station. Following this, the robot control panel will shut off automatically, and cannot be recycled until the holder 18 is brought to a fully up position. Limit switch LS-T is mounted on the grinding wheel cover 16. The cover must be fully closed and locked into position, otherwise the robot control circuit cannot operate. An indicator light on LS-T will be lighted. The robot control circuit is operable only when the cover 16 is fully closed and the holder 18 is completely up.

The following is an indentification of the time-delay relays and their functions. TD-1 delays the robot arm to allow for drill ejection from the grinding head (e.g. 1.0 seconds). TD-2 delays locator extend (minimum setting). TD-3 initiates drill rejection if flute timing is not accomplished (e.g. 3.5 seconds). TD-4 delays arm retract to allow grinding-head collet to clamp drill (minimum setting). TD-5 initiates drill rejection if the drill cannot pass through the grinding-head bushing (5.0 seconds). TD-6 prevents grinding cycle from starting when arm is in extended position at locator station (minimum setting). TD-7 delays drill-ejector pin actuation to allow alignment of pin and grinding-head bushing (minimum setting). TD-8 initiates drill reject and stops cycle if grinding head is not fully up (7.0 seconds). IT-1 momentary pulse to eject drill from grinding head (0.5 seconds). IT-2 momentary pulse to start grind cycle (minimum setting). IT-3 momentary pulse to reset cycle (minimum setting). IT-4 used in conjunction with TD-8 (minimum setting). IT-5 used in conjunction with TD-5 (minimum setting).

The various components which are shown in the electrical schematic diagrams (FIGS. 50A–50D) but which have not been described are shown for the purpose of completing the circuit diagram. The function of these components in the circuit will be readily understood by a person skilled in the art.

It is to be understood that the invention is not limited to the disclosed embodiment. The claimed functions can be performed by devices other than those which have been illustrated and described. The grinding machine and the drill bit feed mechanism can be built into a single new machine, rather than the drill bit feed system being an add on to an existing grinding machine. Furthermore, the automatic drill bit feed system of the invention can be used with various types of drill bit sharpening machines.

What is claimed is:

1. Mechanism for feeding drill bits one at a time into a drill bit holder of a drill bit sharpener which includes a grinding wheel, comprising:

a drill bit carrier movable between a drill bit receiving position and a drill bit inserting position, said carrier including a collet for receiving the shank end of a drill bit when the carrier is in its drill bit receiving position, and means for rotating the collet in position about the drill bit axis;

means for inserting a drill bit into the collet when the drill bit carrier is in its drill bit receiving position and closing the collet to grip said drill bit;

locator means for sensing the position of the drill bit in the collet and rotating the collet an amount sufficient to position the point of the drill bit for proper contact with the grinding wheel;

means for then moving the carrier from its drill bit receiving position into its drill bit inserting position, said drill bit being aligned with the drill bit holder when the carrier is in its drill bit inserting position;

means for then moving the collet endwise an amount sufficient to insert the drill bit into the drill bit holder and opening the collet to release the drill bit from the collet; and means for moving the carrier back into its drill bit receiving position, for receiving another drill bit.

2. Mechanism according to claim 1, wherein the drill bit carrier includes a generally horizontal arm and means for swinging the arm in position about a generally vertical axis, for moving it between its drill bit receiving and drill bit inserting positions, and wherein the collet is at one end of the arm.

3. Mechanism according to claim 2, wherein the means for inserting a drill bit into the collet includes a conveyor for moving the drill bit into a position of spaced axial alignment with the collet when the drill bit carrier is in its drill bit receiving position, and extendible/retractable pushrod means extendible against the point end of the drill bit, for moving the drill bit endwise from such position toward the collet, and its shank end into the collet.

4. Mechanism according to claim 3, wherein the conveyor is movable in position between an extended position in which a drill bit to be installed into the chuck is in a position of spaced axial alignment with the chuck, and a retracted position spaced laterally away from the extended position.

5. Mechanism according to claim 1, wherein the means for inserting a drill bit into the collet includes a conveyor for moving the drill bit into a position of spaced axial alignment with the collet, and pushrod means extendible against the point end of the drill bit, for moving the drill bit endwise from such position toward the collet, and its shank end into the collet.

6. Mechanism according to claim 5 wherein the conveyor is a walking beam conveyor which advances a plurality of drill bits sideways, one step at a time, to an end position on the conveyor, and said conveyor includes means mounting it for movement between an extended position, in which a drill at the end position is in said position of spaced axial alignment with the collet, and a retracted position in which the end position of the conveyor is spaced back from the region through which the pushrod means moves.

7. Mechanism according to claim 1, where the locator means includes a stylus positioned to enter a flute of the drill bit, and means for sensing a predetermined position of the stylus in the flute and stopping the rotation of the collet in response to the stylus reaching such predetermined position.

8. Mechanism according to claim 7, wherein the stylus is positioned generally vertically above the drill bit and it falls by gravity into the flute.

9. Mechanism according to claim 8, comprising a support for the stylus mounted for pivotal movement about a horizontal axis in response to the stylus dropping into the drill bit flute, and wherein said means for sensing a predetermined position of the stylus includes the stylus support.

10. Mechanism according to claim 9, wherein said means for sensing the predetermined position of the stylus includes a sensor for sensing a position of a portion of the stylus support.

11. Mechanism according to claim 1, comprising means for sensing a buildup in a flute portion of the drill bit when the drill bit is in the collet of the drill bit carrier and the drill bit carrier is in a drill bit receiving position, and reject means operable in response to an excessive build-up to remove the drill bit from the collet before the drill bit carrier moves into its drill bit inserting position.

12. Mechanism according to claim 11, wherein the locator means includes a stylus positioned to enter a flute of the drill bit, and means for sensing position of the stylus in the flute and stopping the rotation of the collet in response to the stylus reaching a predetermined position in said flute, and wherein said means for sensing a build-up in the flute includes the stylus and the means for sensing the position of the stylus in the flute.

13. Mechanism according to claim 1, wherein the locator means includes a stylus positioned generally vertically above the drill bit, and positioned to fall by gravity into a flute of the drill bit, means for sensing a predetermined position of the stylus in the flute in stopping the rotation of the collet, in response to the stylus reaching such predetermined position, and support structure for the stylus including a post spaced generally axially of the collet when the carrier is in its drill bit receiving position, a support arm connected to the top of the post and extending generally horizontally toward the collet, said stylus being connected to an end portion of the support arm, and wherein the means for inserting a drill bit into the collet includes a conveyor for moving the drill bit into a position of spaced axial alignment with the collet, and pushrod means extendible against the point end of the drill bit, for moving the drill bit endwise from such position toward the collet, and its shank end into the collet.

14. Mechanism for feeding drill bits one at a time into a drill bit holder of a drill bit sharpener which includes a grinding wheel, comprising:

a drill bit carrier movable between a drill bit receiving position and a drill bit inserting position, said carrier including a collet for receiving the shank end of a drill bit when the carrier is in its drill bit receiving position, and means for rotating the collet in position about the drill bit axis;

means for inserting a drill bit into the collet when the drill bit carrier is in its drill bit receiving position and closing the collet to grip said drill bit;

locator means for sensing the position of the drill bit in the collet and rotating the collet an amount sufficient to position the point of the drill bit for proper contact with the grinding wheel, said locator means including a stylus positioned to enter a flute of the drill bit, and means for sensing a predetermined position of the stylus in the flute and stopping the rotation of the collet in response to the stylus reaching such predetermined position;

means for then moving the carrier from its drill bit receiving position into its drill bit inserting position, said drill bit being aligned with the drill bit holder when the carrier is in its drill bit inserting position;

means for then moving the collet endwise an amount sufficient to insert the drill bit into the drill holder and opening the collet to release the drill bit from the collet;

means for moving the carrier back into its drill bit receiving position, for receiving another drill bit; and a bushing for surrounding and supporting the drill bit while it is being rotated; and a support for the bushing that is mounted for axial movement of the bushing between an extended position in which the drill bit is in the bushing and a retracted position in which said bushing is spaced axially from the drill bit point.

15. Mechanism according to claim 14, comprising means for positioning the stylus above the drill bit, the bushing, and the bushing support during movement of the bushing and its support, in a position in which the stylus will not interfere with such movement.

16. Mechanism according to claim 15, wherein the stylus support includes a generally horizontal arm from which the stylus depends, means mounting such arm for pivotal movement about a generally horizontal axis spaced from the stylus, and a generally vertical portion depending from said arm at a location between the stylus and the pivot axis, and wherein said means for sensing the predetermined position of the stylus includes a sensor which senses position of a portion of said vertical member relative to such sensor.

17. Mechanism according to claim 16, further comprising pusher means extendible against said generally vertical member, in a direction to cause an upward swinging movement of the support arm for the stylus for moving the stylus upwardly out of the way of the bushing and its support, during movement of the bushing and its support between their two positions.

18. Mechanism for feeding drill bits one at a time into a drill bit holder of a drill bit sharpener which includes a grinding wheel, comprising:

a drill bit carrier movable between a drill bit receiving position and a drill bit inserting position, said carrier including a collet for receiving the shank end of a drill bit when the carrier is in its drill bit receiving position, and means for rotating the collet in position about the drill bit axis, a generally horizontal arm, and means for swinging the arm in position about a generally vertical axis, for moving it between its drill bit receiving and drill bit inserting positions, and wherein the collet is at one end of the arm;

means for inserting a drill bit into the collet when the drill bit carrier is in its drill bit receiving position and closing the collet to grip said drill bit, including a conveyor for moving the drill bit into a position of spaced axial alignment with the collet when the drill bit carrier is in its drill bit receiving position, and extendible/retractable pushrod means extendible against the point end of the drill bit, for moving the drill bit endwise from such position toward the collet, and its shank end into the collet, wherein the conveyor is movable in position between an extended position in which a drill bit to be installed into the chuck is in a position of spaced axial alignment with the chuck, and a retracted position spaced laterally away from the extended position;

locator means for sensing the position of the drill bit in the collet and rotating the collet an amount sufficient to position the point of the drill bit for proper contact with the grinding wheel;

means for then moving the carrier from its drill bit receiving position into its drill bit inserting position, said drill bit being aligned with the drill bit holder when the carrier is in its drill bit inserting position;

means for then moving the collet endwise an amount sufficient to insert the drill bit into the drill holder and opening the collet to release the drill bit from the collet;

means for moving the carrier back into its drill bit receiving position, for receiving another drill bit;

a bushing for surrounding and supporting the drill bit while it is being rotated; and a support for the bushing that is movable, for axial movement of the bushing, between a position in which the drill bit is in the bushng and a retracted position in which said drill bit and bushing are spaced out from the drill bit point, such movement of the bushing and its support occurring in a space occupied by a portion of the conveyor when the conveyor is extended, wherein the retraction of the conveyor opens the space for movement of the bushing and its support through the space.

19. Mechanism according to claim 18, wherein the locator means includes a stylus positioned to enter a flute of the drill bit, and means for sensing a predetermined position of the stylus in the flute and stopping the rotation of the collet in response to the stylus reaching such predetermined position.

20. Mechanism according to claim 19, wherein the stylus is positioned generally vertically above the drill bit and it falls by gravity into the flute of the drill bit.

21. Mechanism according to claim 20, comprising a support for the stylus mounted for pivotal movement about a horizontal axis in response to the stylus dropping into the drill bit flute, and wherein said means for sensing a predetermined position of the stylus includes the stylus support.

22. Mechanism according to claim 21, wherein said means for sensing the predetermined position of the stylus includes a sensor for sensing a position of a portion of the stylus support.

23. Mechanism according to claim 22, wherein the stylus support includes a generally horizontal arm from which the stylus depends, means mounting such arm for pivotal movement about a generally horizontal axis spaced from the stylus, and a generally vertical portion depending from said arm at a location between the stylus and the pivotal axis, and wherein said means for sensing the predetermined position of the stylus includes a sensor which senses position of a portion of said vertical member relative to said sensor.

24. Mechanism according to claim 23, further comprising pusher means extendible against said generally vertical member, in a direction to cause an upward swing movement of the support arm for the stylus, moving the stylus upwardly out of the way of the bushing and its support, during movement of the bushing and its support between the two positions.

25. Mechanism for feeding drill bits one at a time into a drill bit holder of a drill bit sharpener which includes a grinding wheel, comprising:

a drill bit carrier movable between a drill bit receiving position and a drill bit inserting position, said carrier including a collet for receiving the shank end of a drill bit when the carrier is in its drill bit receiving position, and means for rotating the collet in position about the drill bit axis;

means for inserting a drill bit into the collet when the drill bit carrier is in its drill bit receiving position and closing the collet to grip said drill bit;

locator means for sensing the position of the drill bit in the collet and rotating the collet an amount sufficient to position the point of the drill bit for proper contact with the grinding wheel;

means for then moving the carrier from its drill bit receiving position into its drill bit inserting position, said drill bit being aligned with the drill bit holder when the carrier is in its drill bit inserting positions;

means for then moving the collet endwise an amount sufficient to insert the drill bit into the drill holder and opening the collet to release the drill bit from the collet;

means for moving the carrier back into its drill bit receiving position, for receiving another drill bit;

wherein the means for inserting a drill bit into the collet includes a conveyor for moving the drill bit into a position of spaced axial alignment with the collet, and pushrod means extendible against the point end of the drill bit, for moving the drill bit endwise from such position toward the collet, and its shank end into the collet;

wherein the conveyor is movable in a direction generally perpendicular to the position of the center line axis of the collet when the carrier is in its drill bit receiving position, between an extended position in which a drill bit to be installed into the collet is in a position of spaced axial alignment with the collet, and a retracted position spaced laterally back away from the extended position;

wherein the locator means includes a bushing and a bushing support which have a retracted position in which the bushing is coaxial with the collet, and is spaced axially away from the collet a distance sufficient to allow the conveyor, when it is extended, to move into the axial space between the collet and the bushing;

wherein the bushing and its support are extendible toward a drill bit in the collet an amount sufficient to allow the point end portion of a drill bit in the collet to enter through the bushing and project outwardly beyond the bushing; and wherein during such extension the bushing and its support move through the space vacated by the conveyor when it moves back from its extended position into its retracted position.

26. Mechanism according to claim 25, wherein the locator means includes a stylus positioned to enter a flute of the drill bit, in the region of the drill bit which projects out from the bushing, when the bushing is in its extended position, and means for sensing a predetermined position of the stylus in the flute and stopping rotation of the collet in response to the stylus reaching such predetermined position.

27. Mechanism according to claim 26, wherein the stylus is positioned generally vertically above the drill bit and it falls by gravity into the flute.

28. Mechanism according to claim 27, comprising mechanism for lifting the stylus above the drill bit and holding it in such position during movement of the bushing between its retracted and extended positions, so that the stylus will collide with the drill bit during such movement.

* * * * *